US006065546A

United States Patent [19]

Uetake et al.

[11] Patent Number: 6,065,546

[45] Date of Patent: May 23, 2000

[54] FIRE EXTINGUISHING AND SMOKE ELIMINATING APPARATUS AND METHOD USING WATER MIST

[75] Inventors: Tohru Uetake; Yasunobu Ohshima; Takato Kumagai; Toshihiko Ariyama; Noriaki Iwase; Hisao Shimizu, all of Tokyo, Japan

[73] Assignee: Bunka Shutter Co., Ltd., Tokyo, Japan

[21] Appl. No.: 09/061,288

[22] Filed: Apr. 17, 1998

[30] Foreign Application Priority Data

Apr. 23, 1997 [JP] Japan ..... 9-106304
Mar. 4, 1998 [JP] Japan ..... 10-052012

[51] Int. Cl.[7] ..... A62C 35/00

[52] U.S. Cl. ..... 169/61; 169/16; 169/90

[58] Field of Search ..... 169/56, 60, 61, 169/70, 57, 5, 16, 90

[56] References Cited

U.S. PATENT DOCUMENTS

| | | | |
|---|---|---|---|
| 2,341,437 | 2/1944 | Getz | 169/61 X |
| 3,590,924 | 7/1971 | Emmons | 169/16 |
| 3,826,180 | 7/1974 | Hayashi | 169/61 X |
| 3,888,641 | 6/1975 | Ito | 169/43 X |
| 3,993,138 | 11/1976 | Stevens et al. | 169/61 |
| 4,453,155 | 6/1984 | Cooper | 340/289 |
| 5,651,417 | 7/1997 | Coughlin | 169/51 |
| 5,664,631 | 9/1997 | Szocs | 169/71 X |

*Primary Examiner*—Kevin Weldon
*Attorney, Agent, or Firm*—Kanesaka & Takeuchi

[57] ABSTRACT

The fire extinguishing and smoke eliminating apparatus using water mist, including a water mist nozzle for spraying fine water particles with a designated particle diameter suitable for smoke generated from different types of objects existing in a section indicating a designated range of a fire extinguishing and smoke eliminating object or different types of smoke itself.

13 Claims, 17 Drawing Sheets

| TEMPERATURE SENSOR / SMOKE SENSOR | OPERATION START TEMPERATURE / OPERATION START DENSITY | No. OF SP / No. OF WM | No. OF NEAR SPRINKLER (SP) | No. OF A LITTLE DISTANCE WATER MIST (WM) |
|---|---|---|---|---|
| 5a | XXX | 2a | 2b, 2d | 3c, 3e, 3g |
| 7a | ZZZ | 3a | | |
| 5b | XXX | 2b | 2a, 2c, 2e | 3d, 3h, 3f |
| 7b | ZZZ | 3b | | |
| ⋮ | | | | |

FIG.7

| TEMPERATURE SENSOR | No. OF WM | No. OF SP |
|---|---|---|
| 5a | 3a | 2a |
| 5b | 3b | 2b |
| ⋮ | | |

FIG.9

| ROOM NUMBER | No. OF WM3 | TEMPERATURE SENSOR No. |
|---|---|---|
| | No. OF WM13 | SMOKE SENSOR No. |
| 1a | 3a | 5a |
| | 13a | 7a |
| 1b | 3b | 5b |
| | 13b | 7b |
| ⋮ | | |

FIG.14(a)

| ROOM NUMBER | STORED MATTER |
|---|---|
| 1a | WOOD |
| 1b | LAMP OIL |
| 1c | LAMP OIL |
| 1d | WOOD |
| ⋮ | |

FIG.14(b)

| STORED MATTER | CLASSIFICATION OF USED WM | OPERATION START TEMPERATURE |
|---|---|---|
| | | OPERATION START SMOKE DENSITY |
| WOOD | 3 (3a~3n) | X1 |
| | | Y1 |
| LAMP OIL | 13 (13a~13n) | X2 |
| | | Y1 |

FIG.14(c)

| NOZZLE (A) | SPRAY PRESSURE (kgf/cm$^2$) | | | | |
|---|---|---|---|---|---|
| | 1 | 3 | 5 | 7 | 10 |
| 5 | ○/△ | ○/△ | ○/△ | — | — |
| 10 | ○/△ | ○/△ | ○/△ | — | — |
| 20 | ○/△ | ○/△ | ○/△ | ○ | ○ |
| 35 | △ | △ | ○ | ○ | ○ |

○ :LAMP OIL
△ :WOOD

FIG.17

FIRE EXTINGUISHING AND SMOKE ELIMINATING APPARATUS AND METHOD USING WATER MIST

BACKGROUND OF THE INVENTION

Detailed Description of the Invention

1. Field of the invention

This invention relates to a system for extinguishing fire and eliminating smoke at the time of a fire and particularly to the fire extinguishing and smoke eliminating apparatus and method using water mist.

2. Prior art

The water discharge equipment such as a sprinkler using water or the like, the ejector device of a chemical fire extinguisher and the fire extinguishing equipment different in medium used in extinguishing fire and way of extinguishing fire (fire extinguishing form) have been used heretofore in fighting a fire at the time of a fire.

However, in the case of fire extinguishing by the water discharge equipment using a sprinkler, the quantity of discharged water is large so that the floor is inundated with water, and further downstair leakage of water is large so that sometimes the building can not be used again.

On the other hand, fire extinguishing using a chemical extinguisher is not favorable from the environmental point of view, and gas generated by fire extinguishing is undesirable to the human body.

Removing of smoke generated by a fire is performed mechanically or naturally, but if the working is not effective, sometimes the refugees are poisoned by the smoke, or the visual range of a refuge passage is intercepted by the smoke to be an obstacle to refuge.

This invention has been proposed in order to solve the above problems and it is an object of the invention to provide a fire extinguishing and smoke eliminating apparatus and method using water mist, by which at the time of a fire, fire extinguishing and smoke eliminating can be performed efficiently, the quantity of water used in extinguishing a fire can be decreased, and further environmental pollution caused by fire extinguishing can be reduced.

SUMMARY OF THE INVENTION

In order to achieve the foregoing object, according to one aspect of the present invention, the fire extinguishing and smoke eliminating apparatus using water mist comprises a water mist nozzle for spraying fine water particles with a designated particle diameter suitable for smoke generated from various types of objects existing in a section for fire extinguishing and smoke eliminating or smoke of different types.

Preferably, the water mist nozzle is adapted to spray fine water particles with a particle diameter depending upon the type of an object, and may include control means for determining the type of the object or smoke to spray fine water particles with a designated particle diameter suitable for the above type from the water mist nozzle.

The apparatus according to another aspect of the invention comprises:

a water mist nozzle provided in a section indicating a designated range of the object of fire extinguishing and smoke eliminating to spray fine water particles with a designated particle diameter suitable for fire extinguishing and smoke eliminating according to the objects of different types existing in each section;

smoke density detecting means provided in each of said section to detect the smoke density in the section and output a signal corresponding to the smoke density;

a control device in which the type of an object existing in the section is set and stored, and which is adapted to select a water mist nozzle suitable for fire extinguishing and smoke eliminating in the section when it reaches a designated smoke density preset by the types of the objects according to the smoke density signal; and a valve opening and closing mechanism for opening and closing a valve to start and stop spraying operation of the water mist nozzle under the control of the control device.

The apparatus according to another aspect of the invention comprises:

a water mist nozzle provided in a section indicating a designated range of the object of fire extinguishing and smoke eliminating to spray fine water particles with a designated particle diameter suitable for fire extinguishing and smoke eliminating for the objects of different types existing in each section;

temperature detecting means provided in each of the sections to detect the temperature in the section and output a signal corresponding to the temperature;

a control device in which the type of an object existing in the section is set and stored, and which selects water mist nozzle suitable for fire extinguishing and smoke eliminating in the section when it reaches a designated temperature preset by the types of the objects according to the temperature signal; and a valve opening and closing mechanism for opening and closing a valve to start and stop spraying operation of the water mist nozzle under the control of the control device.

The apparatus according to another aspect of the invention, in which a water mist nozzle for spraying fine water particles and another fire extinguishing equipment for extinguishing a fire in the fire extinguishing form different from that of the fine water particles are respectively arranged in a section for fire extinguishing and smoke eliminating, comprises:

detecting means for detecting the time elapsed from the occurrence of a fire or the firing place; and operating means for operating the water mist nozzle and the other fire extinguishing equipment jointly or separately according to the state of a fire detected by said detecting means.

According to the described configuration, a water mist nozzle corresponding to the type of an object is disposed in a room as a section of an object of fire extinguishing and smoke eliminating.

With each water mist nozzle, the temperature of the concerned place is detected by temperature detecting means, and the smoke density is detected by smoke density detecting means.

The control device specifies the room where a fire occurs when a temperature signal of the temperature detecting means reaches a preset designated temperature or when a smoke detection signal of the smoke density detecting means reaches a preset designated density.

Then, a water mist nozzle suitable for an object existing in the room is selected and the valve opening and closing mechanism is controlled to open, and fire extinguishing and smoke eliminating are started.

Fire extinguishing and smoke eliminating by the water mist nozzle can be performed with a small quantity of water, and the floor can be restrained from being inundated so as to reduce downstairs damage by water.

In the apparatus according to another aspect of the invention, one section is set as a designated range of an object of fire extinguishing and smoke eliminating, and a water mist nozzle for spraying fine water particles is disposed in a position along the wall surface in the above one section or at least in a part of the corner of a room.

The apparatus according to another aspect of the invention, in which a water mist nozzle for spraying fine water particles is arranged in another different section adjacent to a section for fire extinguishing, where the occurrence of a fire is under consideration, comprises:

detecting means for detecting a predetermined temperature based on the occurrence of a fire or a place where smoke with a designated density is generated; and operating means for operating the water mist nozzle according to the state of a fire detected by the detecting means.

In the apparatus according to another aspect of the invention, a section indicating a designated section of an object of fire extinguishing and smoke eliminating is a staircase continuous in the direction of height or an upper space such as a stairwell or the like, and in the upper space, the water mist nozzles are arranged in such a manner as to increase in number as it goes toward the higher part.

In the apparatus according to another aspect of the invention, a section indicating a designated range of an object of fire extinguishing and smoke eliminating is a predetermined room and a passage for going in and out of the room, and much more water mist nozzles are arranged in the section than in a fire escape doorway of a room and in a refuge passage.

A method according to the invention is the fire extinguishing and smoke eliminating method applicable to the fire extinguishing and smoke eliminating apparatus which is so constructed that a water mist nozzle for spraying fine water particles and each nozzle of the water discharge equipment such as a sprinkler or the like for discharging fire extinguishing water are respectively arranged in a section for fire extinguishing and smoke eliminating, comprises:

the step of detecting the state of a fire such as the time elapsed from the occurrence of a fire to fire extinguishing, the place where a fire occurs; and the step of starting the operation of the water mist nozzle and the water discharge equipment jointly or separately according to the detected state of a fire to extinguish a fire.

In the apparatus according to another aspect of the invention, a water mist nozzle is arranged in such a manner that the nozzle orifice for spraying fine water particles is positioned at a predetermined distance lower than the height position of a ceiling in a section for fire extinguishing and smoke eliminating to eliminate smoke preponderantly for the lower position at a predetermined distance.

In the apparatus according to another aspect of the invention is characterized in that a rack having a plurality of shelves in the direction of height is provided in a section for fire extinguishing and smoke eliminating, and a water mist nozzle for spraying fine water particles for covering the rack is arranged to enable smothering for the interior of the rack.

BRIEF DESCRIPTION OF THE DRAWINGS

FIG. 7 is a virtual diagram showing the preset content stored in a storage part.

FIG. 9 is a virtual diagram showing another preset content stored in the storage part.

FIGS. 14(*a*), (*b*), (*c*) are virtual diagrams showing the preset contents stored in a storage part of the above embodiment.

FIG. 17 is a diagram showing the combination of tested nozzles and atomizing pressure.

DETAILED DESCRIPTION OF PREFERRED EMBODIMENTS

Figure 1A:
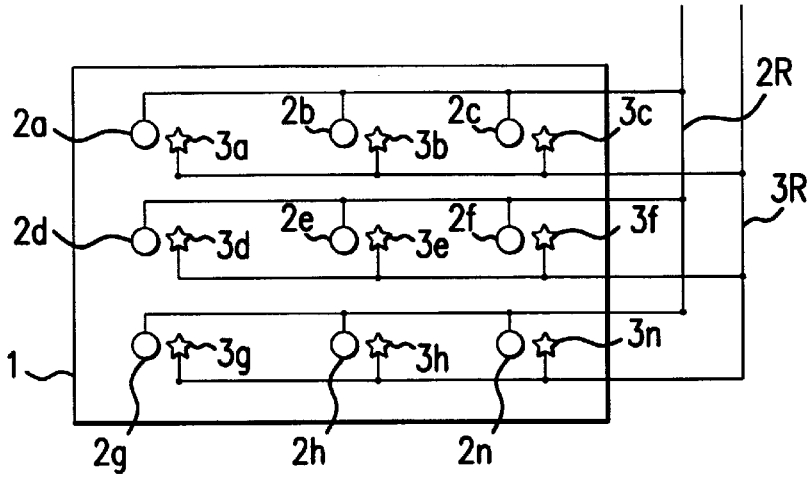
FIGS. 1(*a*) through 1(*d*) are diagrams showing a first embodiment of the present invention, wherein FIGS. 1(*a*) through (*d*) are plan views respectively showing the arrangement of water mist nozzles and sprinkler nozzles in a room.
Figure 1B:
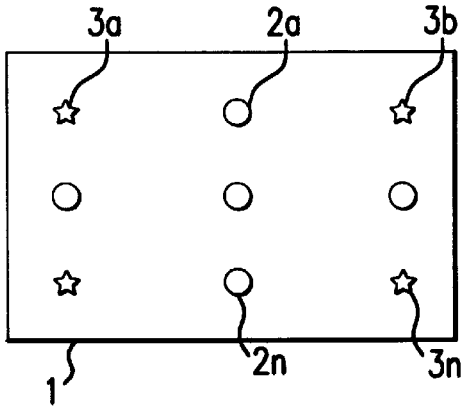
Figure 1C:
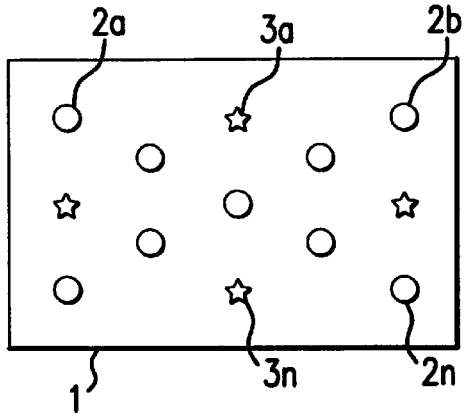
Figure 1D:
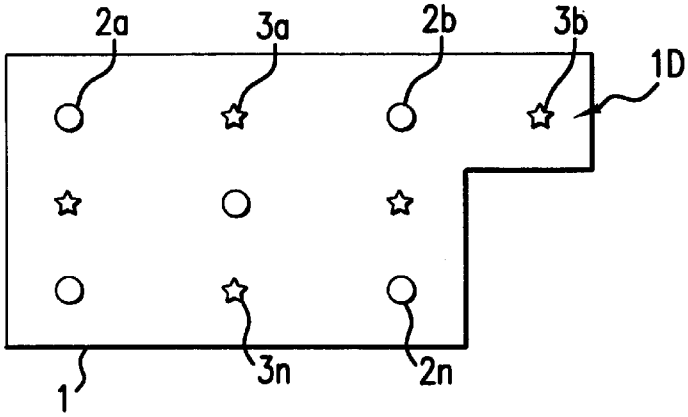

The respective embodiments of the present invention will now be described with reference to the drawings. In the following respective embodiments, a designated range for fire extinguishing and smoke eliminating is taken as a fire extinguishing section.

The fire extinguishing section has not only a closed space such as a room or the like, but sometimes an open space such as a fire escape passage, a tunnel or the like. Further, not only the origin of a fire, but a space such as a fire escape passage directly or indirectly connected to the origin of a fire is sometimes a fire extinguishing section.

Here "fire extinguishing section" is a general term for a section intended for "fire extinguishing" principally, a section intended for "fire extinguishing and smoke eliminating" principally, and a section intended for "smoke eliminating" principally.

In the first and fourth embodiments, "fire extinguishing" is taken as a preferential purpose, and in the second and third embodiments, "smoke eliminating" is taken as a preferential purpose (it does not always mean that the other is not a purpose).

First Embodiment

FIGS. 1(*a*) to (*c*) are arrangement plans respectively showing one embodiment of a fire extinguishing and smoke eliminating apparatus using water mist according to the present invention.

A certain room 1 is shown as a fire extinguishing section in the drawings. The room is closed by walls and doors in the periphery thereof to form one closed space. This is not exceptional, but one closed space is sometimes formed by one single room comparted by a shutter or a partition.

A plurality of sprinkler nozzles 2 (2*a*–2*n*) and water mist nozzles 3(3*a*–3*n*) are arranged in the ceiling of the room 1.

In the example of arrangement of FIG. 1(*a*), water mist nozzles 3*a* to 3*n* are arranged on the sides of the sprinkler nozzles 2*a* to 2*n*.

The respective sprinkler nozzles 2*a* to 2*n* are connected to a water source such as a water supply tank through a passage 2R to supply water at a designated pressure.

Further, the respective water mist nozzles 3*a* to 3*n* are connected to a water source such as a water supply tank through a passage 3R to supply water at a designated pressure.

Figure 2:
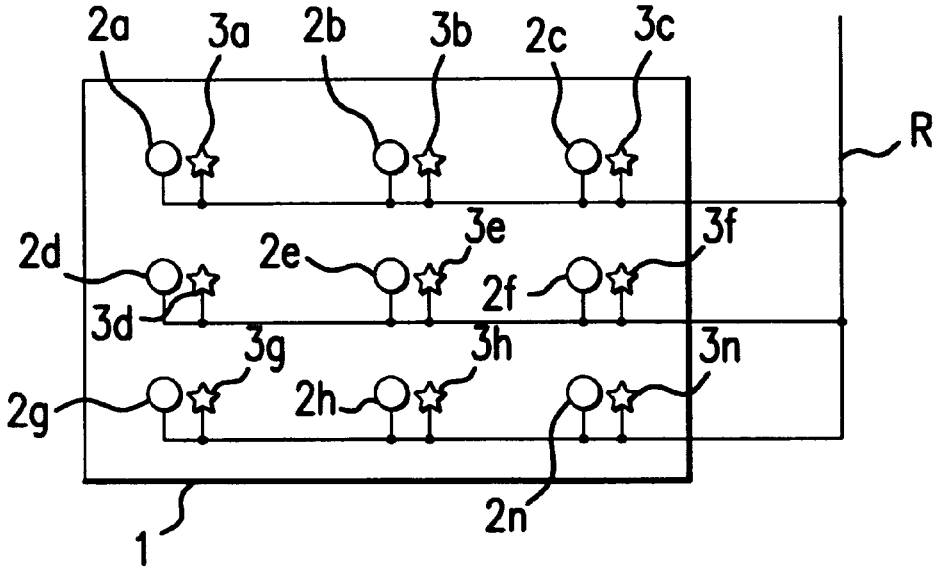
FIG. 2 is a diagram showing another example of construction of a passage shown in FIG. 1(*a*).

FIG. 2 is a diagram showing another constitution of a passage R. The sprinkler nozzle 2 and the water mist nozzle 3 shown in FIGS. 1(*a*)–1(*d*) may be, as shown in FIG. 2, constructed so that water from a water source is supplied to the nozzles through a single passage R.

Figure 3:
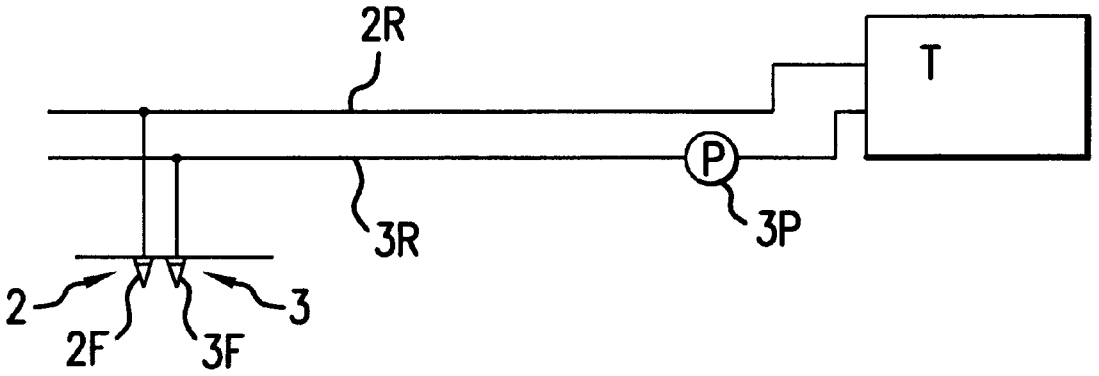
FIG. 3 is a diagram showing the connecting structure of a passage and a water supply tank.

FIG. 3 is a diagram showing the connecting structure of passages and a water supply tank. These passage 2R, 3R may be connected to the same water supply tank T. In the case of making the hydraulic pressure applied to the water mist nozzle 3 higher than that of the sprinkler nozzle 2, a pressure pump 3P is disposed on the passage 3R side.

Reference literature about the above water mist is cited in the following.

1) "Water System Fire Extinguish Equipment as Halon Substitute Fire Extinguish Equipment"

("Fire" Vol. 45 No. 6 December, 1995 p17 to p20, Journal issued by Japan Fire Corporation Institution)

2) "Summary of International Meeting on Water Mist Fire Extinguish System"

("Fire" Vol. 44 No. 3 June, 1994 p31 to p33, Journal issued by Japan Fire Corporation Institution)

The water mist nozzle 3 is adapted to atomize water to spray water mist (fine water particles; particles with a particle diameter of 40 to 400 $\mu$m). If a waterdrop particle has a particle diameter larger than 400 $\mu$m, it acts on the surface of a flammable liquid to be stirred, so it is not effective for fire extinguishing for a flammable liquid.

As compared with a general sprinkler, the water mist has such a characteristic that the particle diameter is very small and the quantity of water is small.

Though there are plural methods of expressing a liquid particle, in the present invention, the particle diameter designates the Sauter's mean diameter. The Sauter's mean diameter will now be described.

On measuring the sampled spray droplets group, if the number of particles with the diameter xi (x1−Δx to x1+Δx) is Δni, the total volume of spray is proportional to $\Sigma Xi^3 \Delta ni$, and the total surface area is proportional to $\Sigma Xi^2 \Delta ni$. The mean particle diameter of the surface area reference is expressed by the following equation (Table 1).

TABLE 1

$$\bar{d}_{32}(\bar{d}_S, \text{SMD}) = \frac{\sum Xi^3 \Delta ni}{\sum Xi^2 \Delta ni}$$

Xi: diameter of particle Δni: number of particles with the diameter Xi
$\bar{d}_{32}$ is volume/surface mean diameter, that is, called Sauter's mean diameter ds or SDM.

The Sauter's mean diameter is synonymous with the reciprocal of specific surface area of spray, which indicates that the smaller the mean particle diameter is, the higher the burning velocity is.

As described in the above reference literature, the following effects are obtained by the fine water particles of the water mist nozzle 3.

(1) Cooling Effect (Removal of Combustibility)

The mist-like water is fine water particles so that the total surface area becomes larger to easily absorb heat. Accordingly, the evaporation rate is high, and in the evaporation process, heat is removed from a fire. In order to stop burning, it will be sufficient to remove heat of combustion by 30 to 60%.

(2) Oxygen Removing Effect (Lowering of Oxygen Content)

Water vapor expanded by evaporation displaces air in the periphery of a fire to lower the oxygen content and stop burning.

(3) Radiant Heat Interception Effect (Decrease in Radiant Heat)

The mist-like water absorbs radiant heat emitted from the origin of a fire to prevent the occurrence of burning and flashover to the environs. As the particles are small, radiant heat can be absorbed effectively.

(4) Smoke Isolation and Smoke Eliminating Effect

The smoke eliminating action is obtained with the fire extinguishing action. Further, a smoke isolation function prevents smoke from being diffused to the surroundings of the sprayed place and entering from the surroundings produced.

The sprinkler nozzle 2 and the water mist nozzle 3 are provided with temperature fuses 2F, 3F fused at a designated temperature which are respectively disposed in the connecting parts to the passages 2R, 3R. Normally, spraying is put in the stop state by the temperature fuses 2F, 3F.

These temperature fuses 2F, 3F used are fused at different temperatures. The fuses are set in such a manner that the temperature fuse 3F provided on the water mist nozzle 3 is fused at a comparatively lower temperature, and the temperature fuse 2F of the sprinkler nozzle 2 is fused at a comparatively higher temperature.

The temperature fuses 2F, 3F have two functions as detecting means for detecting the temperature of a fire and operating means for starting spraying by fusion.

According to the described constitution, if a fire is caused in the room 1, the temperature distribution is generated in such a manner that the temperature is highest at the center of the origin of the fire, and as it is located away from the origin of the fire, the temperature is lowed (e.g. it is substantially radially spaced).

For example, if the origin of a fire is just under the sprinkler nozzles 2*a*, 3*a*, the temperatures of the sprinkler nozzle 2*a* and the water mist nozzle 3*a* rise most.

Thus, first the temperature fuse 3F set to a lower temperature is fused, so that water mist is sprayed from the water mist nozzle 3*a*.

At this time, if the temperature of another water mist nozzle 3*b* or 3*d* adjacent to the water mist nozzle 3*a* rises, the temperature fuse 3F is fused to spray water mist also from the water mist nozzle 3*b* or 3*d*.

Since the fusing temperature of the temperature fuse 3F is set to a lower temperature, after the occurrence of a fire, in its initial stage, spraying from the water mist nozzle 3*a* is started.

The water mist is excellent in the described fire extinguishing effect in the initial stage of a fire, and operated in the initial stage to reduce the spread of a fire to the minimum. Further, the quantity of generated smoke can be decreased by the smoke eliminating effect, so that persons in the room 1 can quickly escape.

When the fire is extinguished in this initial stage, the quantity of water sprayed from the water mist nozzle 3 is small, so that the quantity of discharged water can be reduced remarkably. Thus, damage by water (e.g. downstair leakage) can be decreased.

However, if the strength of the fire is not reduced through spraying from the above water mist nozzle 3, the sprinkler nozzle 2 in a place where the temperature fuse 2F is fused is operated.

Fire extinguishing by the sprinkler is performed with a large quantity of water to prevent the spread of a fire.

As described above, in the initial stage of a fire, only the water mist nozzle 3 near the origin of a fire starts spraying, and in the middle and its following stage of the fire, full-scale fire extinguishing work by the sprinkler nozzle 2 is started.

Thus, in the initial stage of a fire, the quantity of water used is smaller, fire extinguishing can be performed efficiently and damage by water can be reduced. Furthermore, in the middle and its following stage of the fire, fire extinguishing can be switched to full-scale fire extinguishing work.

Each one pair of a sprinkler nozzle 2 and a water mist nozzle 3 adjacent to each other is disposed on the ceiling in the room 1. In this case, while the sprinkler nozzle 2 is operated in a high temperature place, in a place distant from the place, not the sprinkler nozzle 2, the water mist nozzle 3 starts spraying.

Accordingly, even after the operation of a certain sprinkler nozzle 2 is started in the room 1, in a low temperature place distant from the origin of a fire, fire extinguishing and smoke eliminating are efficiently performed from the water mist nozzle 3. Thus, the quantity of water used in the whole can be decreased, and damage by water can be reduced as much as possible.

In the above example of construction, each one pair of a sprinkler nozzle 2 and a water mist nozzle 3 adjacent to each other is disposed. This is not restrictive, but the sprinkler nozzle 2 and the water mist nozzle 3 may be separately arranged in the room 1.

For example, in an example shown in FIG. 1(*b*), the water mist nozzles 3(3*a*–3*n*) are arranged in the corners of the room 1. In this case, the sprinkler nozzles 2(2*a*–2*n*) are disposed in the central area of the room and between the water mist nozzles 3.

By the arrangement of the water mist nozzles 3 in the corners of the room 1, the visual range in the corner can be secured by utilizing the smoke eliminating effect so as to produce the effect of preventing loss (the dead end) of a fire escape path.

In the corner, the supply of an air flow can be easily intercepted by a wall or the like, so that the oxygen removing effect by water mist can be easily exhibited so as to easily extinguish a fire more efficiently.

In an example shown in FIG. 1(*c*), the water mist nozzles 3 are arranged along the wall of the room. The water mist nozzles 3 are arranged outside of the main fire extinguishing range in the room 1. That is, in the room 1, the sprinkler nozzles 2 are arranged in a designated main fire extinguishing range according to the previously estimated fire extinguishing and smoke eliminating object area.

In this case, the water mist nozzle 3 is separated from the sprinkler nozzle 2. Thus, it is possible to decrease the possibility that the effective fire extinguishing function of the water mist is obstructed by the water discharged by the sprinkler nozzle 2. Accordingly, it is expected to prevent reduction of fire extinguishing and smoke eliminating effect by the water mist nozzle 3.

In an example shown in FIG. 1(*d*), the room 1 has, as shown in the drawing, a part projected with a small area. In the thus constructed room 1, the water mist nozzle 3(*b*) is disposed preponderantly in the narrow part 1D. Though the narrow part is easy to be filled with smoke, the smoke in the part 1D can be eliminated by spraying of the water mist nozzle 3*b*. Especially, the visual range in this narrow part 1D can be secured so as to produce an effect of preventing loss (the dead end) of a fire escape path.

As described above, in the case of a corner of the room 1, that is, a position along the wall, the corner of the room or a deformed room, the water mist nozzle 3 is disposed preponderantly in the partially projected part. Thus, the oxygen removing effect by water mist can be easily exhibited in a place where the flow and supply of air are intercepted by a wall or the like, so that fire extinguishing can be easily performed more efficiently.

If some of fine water particles sprayed from the thus arranged water mist nozzles 3 are applied to the wall surface, the smoke eliminating effect in the vicinity of the wall surface can be obtained.

Also in these drawings, the sprinkler nozzles 2 and the water mist nozzles 3 are connected to a water source through the passages 2R, 3R similar to the above.

In any configuration, in the case of equally arranging the sprinkler nozzles 2 and the water mist nozzles 3 in the room 1, initial fire extinguishing by the water mist nozzles 3 can be performed equally over the whole area in the room 1. On the other hand, even if initial fire extinguishing is not performed, full-scale fire extinguishing work by the sprinkler nozzles 2 can be performed uniformly over the whole area in the room 1.

Figure 4:
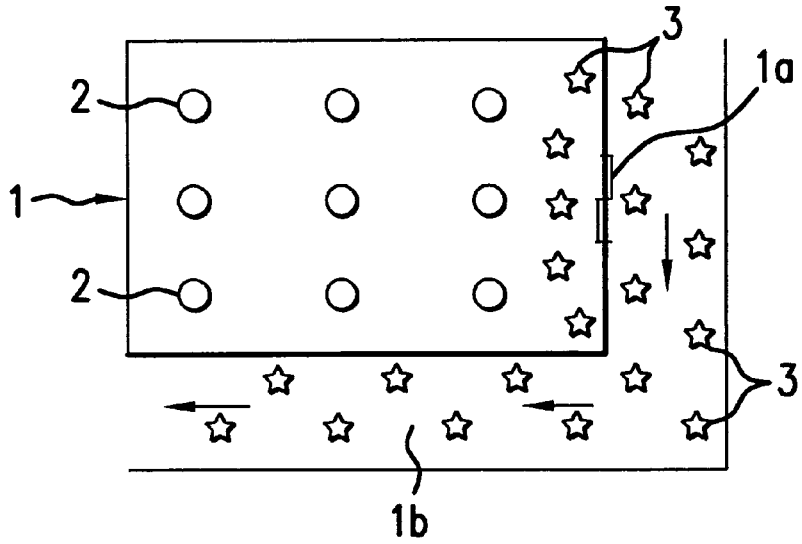
FIG. 4 is a plan view showing another constitutive example of arrangement of water mist nozzles.

FIG. 4 is a plan view showing another configuration of water mist nozzles 3.

In the example shown in the drawing, the sprinkler nozzles 2 are arranged entirely in the room 1. Further, the water mist nozzles 3 are disposed preponderantly in the fire escape doorway (an entrance and exit) 1*a* part from the room 1, and a passage 1*b* part. Here the room 1 is set as a fire extinguishing section where the occurrence of a fire is considered. When this room 1 is the origin of a fire, the passage 1*b* is a different section adjacent to the place where the fire is caused. The water mist nozzles 3 are arranged in this different section, that is, in the passage 1*b* part.

Thus, above the fire escape passage for persons, the water mist nozzles 3 are arranged, whereby after a fire is caused in the room 1, the fire escape passage part is subjected to smoke eliminating, so that the fire escape passage can be visually confirmed. Further, guiding to the fire escape doorway can be suitably conducted and also the prevention of the spread of a fire to the escape passage can be expected. At this time, the fire in the room 1 is extinguished by the sprinkler nozzles 2. When the water mist nozzles 3 are installed as shown in the drawing, it is possible to obtain an effect of intercepting the smoke to keep the smoke from the room 1 where a fire is caused and from entering the passage 1*b* which is a fire escape passage.

In addition to the above configuration, another arrangement is such that the room 1 may be taken as a section, and the water mist nozzles 3 may be disposed not only in a section directly adjacent to the room 1, but in a section indirectly adjacent to the section.

For example, the water mist nozzles 3 are arranged in the staircase area and in the other rooms, with the passage 1*b* interposed between them. It is needless to say that the staircase and the other rooms are a places for safety when the room 1 is the place where a fire is caused. In this case, another fire extinguishing equipment can be arranged in the passage part.

Figure 5:
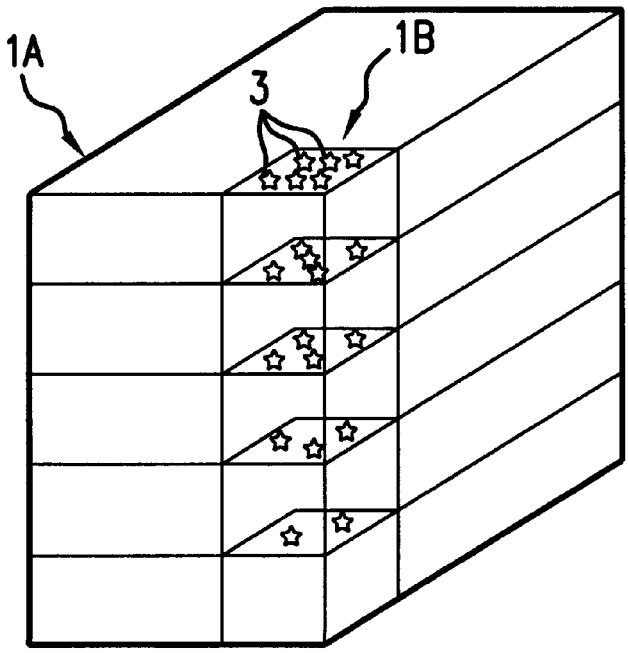
FIG. 5 is a perspective view showing another constitutive example of arrangement of water mist nozzles.

FIG. 5 is a perspective view showing another example of configuration of water mist nozzles 3.

A multistoried building 1A as shown in the drawing has a space 1B continuous in the direction of height of the building. In the space 1B, the higher the floor is, the more the number of water mist nozzles 3 arranged is increased. As an example of the height space 1B, cited are a through hole or space which is continuous in the direction of height and has no story structure, a staircase, and a chimney.

This height space 1B is an independent chimney-like space which is partitioned off the above room, which is especially liable to form a passage for smoke when a fire is caused. If the smoke when a fire is caused enters the height space 1B part, the smoke is easily transmitted to a higher place, that is, a high-rise floor part through the height space 1B.

Accordingly, as shown in the drawing, the higher the floor of the building 1A is, the more the number of water mist nozzles 3 arranged is increased. Thus, the smoke eliminating effect at the high-rise floor part can be obtained so as to reduce damage by smoke. That is, the sprayed fine water particles fall downward after all, so that there are many chances of particles' collision with the smoke.

In the illustrated example, the height space 1B is a staircase, and at every designated step of the staircase, a predetermined number of water mist nozzles 3 is arranged. If the height space 1B is a well structure, the higher it is, the more the number of water mist nozzles 3 arranged at every designated height is increased.

The number of the nozzles arranged is increased with increase in height, that is to say, in the case of judging the whole synthetically, the higher the floor is, the larger the number of nozzles arranged is as compared with that in the lower floor. Accordingly, in the case of comparing two specified floors, it does not always mean that the higher floor always has the larger number of nozzles.

In the described embodiment, the operation of the sprinkler nozzles 2 and the water mist nozzles 3 is started by fusion of the temperature fuses 2F, 3F provided on the respective nozzles.

In the following embodiment, the sprinkler nozzle 2 and the water mist nozzle 3 are provided with valve opening and closing mechanisms 2M, 3M, respectively instead of the fuses. The valve opening and closing mechanisms 2M, 3M are controlled to open and close by a control device.

The constitution of the operation control will now be described.

Figure 6:
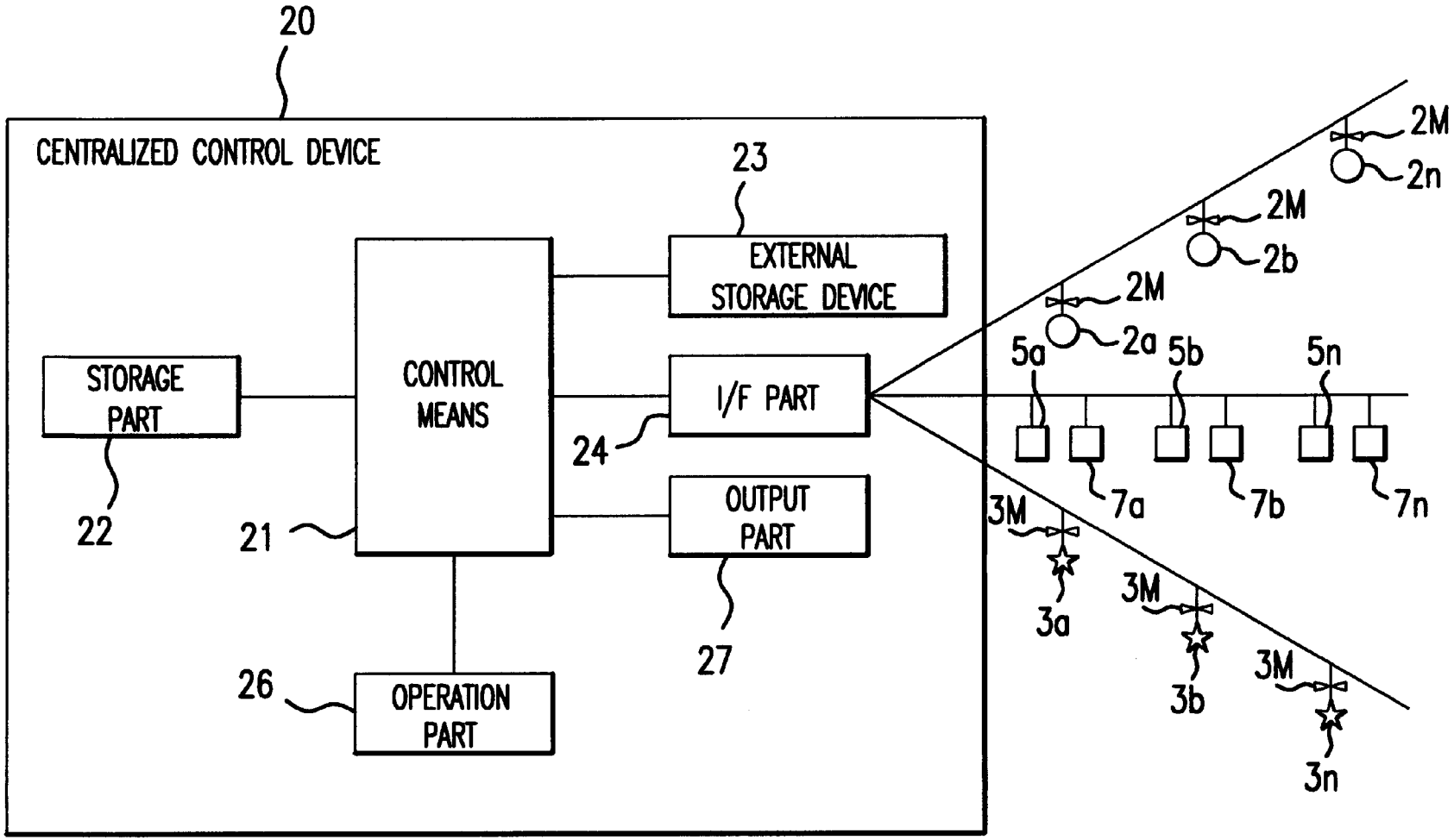
FIG. 6 is a circuit diagram showing a control system of a centralized control device.

FIG. 6 is a circuit diagram showing the control system of a fire extinguishing and smoke eliminating apparatus using water mist according to the present invention.

Spraying from the sprinkler nozzles 2 and the water mist nozzles 3 provided in the room 1 shown in FIG. 1(*a*) is controlled by a centralized control device 20.

The centralized control device 20 can be provided as one facility in an electric control device (e.g. each control for intrusion supervision, on-off operation of illumination, curtain opening and closing, shutter opening and closing of windows and a garage, hot-water supply and so on, the so-called home automation) in the room 1 (or each part of the building 1A shown in FIG. 5).

The centralized control device 20 is so constructed that control means 21 such as CPU or the like executes the supervisory operation mentioned later according to the operation program stored in a storage part 22 such as ROM, RAM or the like. The supervisory information at the time of executing the supervisory operation is stored in an external storage device 23.

A temperature detection signal of a temperature detecting sensor 5 and a smoke density signal of a smoke detecting sensor 7 are respectively input to an interface part (I/F part) 24 and output to the control means 21.

A plurality of temperature detecting sensors 5 and smoke detecting sensors 7 are respectively disposed adjacent to each pair of the sprinkler nozzle 2 and the water mist nozzle 3 part provided in the room 1.

The I/F part 24 selectively controls to open the valve opening and closing mechanism 2M of the sprinkler nozzle 2 and the valve opening and closing mechanism 3M of the water mist nozzle 3 in a corresponding place when a control signal for execution of spraying is input by the control means 21.

The temperature detecting sensor 5 and the smoke detecting sensor 7 form detecting means for detecting a fire, and the valve opening and closing mechanisms 2M, 3M form operating means for starting spraying.

An input part 26 is formed by a keyboard for setting the operation of the centralized control device 20 and operating the execution of spraying by manual operation, a receiving part for receiving the operation instruction information through a line or the like from the outside at need and so on.

An output part 27 is formed by a display device for displaying the supervisory operation condition, an external output device for sending information to the disaster prevention service or the like when the temperature is detected, a printer for printing the history of supervisory information and so on.

FIG. 7 is a virtual diagram showing the preset content stored in the storage part 22.

As shown in the drawing, the numbers of the sprinkler nozzles 2 and the numbers of the water mist nozzles 3 in the places where the respective temperature detecting sensors 5 and smoke detecting sensors 7 are arranged are set and stored in a tabular format.

The operation start temperature and the operation start smoke density are respectively set in the temperature detecting sensor 5 and the smoke detecting sensor 7. These operation start temperature and the operation start smoke density are set by the temperature detecting sensors 5 and the smoke detecting sensors 7, besides they may be set as a single numerical value on the control means 21 side.

Further, the numbers of sprinkler nozzles 2 near the place where the sprinkler nozzle 2 and the water mist nozzle 3 are arranged and the numbers of the water mist nozzles 3 a little distant from the above place are set.

For example, it is a temperature detecting sensor 5*a* and a smoke detecting sensor 7*a* that are arranged in a sprinkler nozzle 2*a* and a water mist nozzle 3*a* part shown in FIG. 1(*a*). The temperature for detecting (a fire) by the temperature detecting sensor 5*a* is set to a designated temperature XXX. The smoke density for detecting (a fire) by the smoke detecting sensor 7*a* is set to a designated density ZZZ.

The numbers of the sprinklers near the sprinkler nozzle 2*a* are set to 2*b*, 2*d*. The numbers of the water mist nozzles a little distant from the sprinkler nozzle 2*a* are set to 3*c*, 3*e*, 3*g*.

The described setting is set for every sprinkler nozzle 2 and water mist nozzle 3 part.

For the purpose of making the processing flexible, the described setting information may be changed except the execution of spraying (even during the operation at need) according to an instruction from the input part 26.

The operation of the apparatus of the described construction will now be described.

Figure 8:
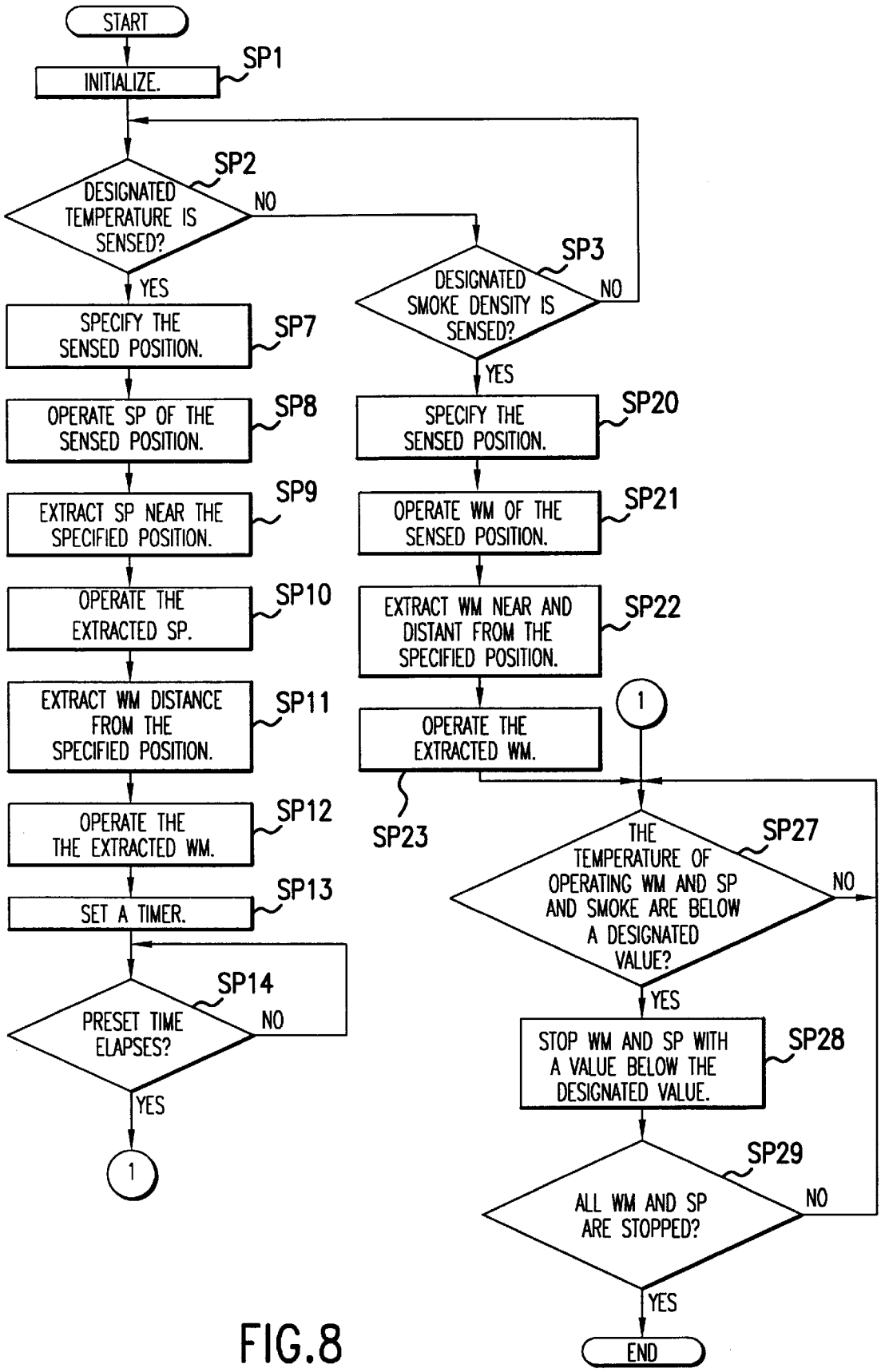
FIG. 8 is a flowchart showing the control content of the centralized control device.

FIG. 8 is a flowchart showing the operation from the supervisory operation—execution of spraying—end by the centralized control device 20.

First, initialization (SP1) with the operation start of the control means 21 is performed.

In the following, the supervisory operation for the occurrence of a fire is conducted.

In supervision, executed is a supervisory loop for cyclically detecting either whether a temperature detecting signal from each temperature detecting sensor 5 exceeds the above operation start temperature or not (SP2), or whether a smoke density signal from each smoke detecting sensor 7 exceeds the operation start density or not (SP3).

Here, if a temperature detection signal which exceeds the operation start temperature due to the occurrence of a fire is input (SP2-YES), the position of the temperature detecting sensor which has output the temperature detecting signal is specified (SP7).

For example, if the temperature detecting sensor 5*a* outputs the temperature detection signal, the sprinkler nozzle 2*a* of the temperature detecting sensor 5*a* part is operated (SP8). The operation is performed with the valve opening and closing mechanism 2M of the sprinkler nozzle 2*a* controlled to open.

Subsequently, the control means 21 extracts the number of the sprinkler nozzle 2 near the specified sprinkler nozzle 2*a* with reference to the described preset content from the storage part 22 (SP9). In the example, the sprinkler nozzles 2*b*, 2*d* are extracted, and the valve opening and closing mechanisms 2M of the sprinkler nozzles 2*b*, 2*d* are also controlled to open (SP10).

Thus, fire extinguishing is started by the sprinkler nozzles 2*a*, 2*b*, 2*d* of the place where a fire is caused, and the surroundings of the place.

Subsequently, the control means 21 extracts the number of the water mist nozzle 3 distant from the specified sprinkler nozzle 2*a* with reference to the described preset content from the storage part 22. In the example, the water mist nozzles 3*c*, 3*e*, 3*g* are extracted and the valve opening and closing mechanisms 3M of the water mist nozzles 3*c*, 3*e*, 3*g* are controlled to open (SP12).

Thus, the water mist nozzles 3*c*, 3*e*, 3*g* in the surroundings of the operating sprinkler nozzles 2*a*, 2*b*, 2*c* are started to operate.

The amount of time elapsed from the start is clocked by a timer in the interior of the control means 21 (SP14), and when a designated time elapses, the state of a fire is again supervised. (transition to SP27).

To be concrete, concerning the temperature detecting sensors 5*a*, 5*b*, 5*c*, 5*d*, 5*e*, 5*g* of the respective places where the sprinkler nozzles 2*a*, 2*b*, 2*d* and the water mist nozzles 3*c*, 3*e*, 3*g* are now operating, it is judged whether a temperature detection signal is below a designated temperature (e.g. when it reaches a designated temperature lower than the temperature detected at the time of starting the operation) or not (SP27).

When one of the temperature detecting sensors 5 is below a designated temperature (SP27-YES), the operation of the sprinkler nozzle 2 or the water mist nozzle 3 of the temperature detecting sensor 5 part is stopped (SP28).

For example, when the temperature detecting sensor 5*g* of the water mist nozzle 3*g* part reaches a designated temperature or less, the valve opening and closing mechanism 3M of the water mist nozzle 3*g* is closed.

Hereinafter, according to the degree of fire extinguishing, when the temperature detection signal of each of the other temperature detecting sensors 5 is below a designated temperature, the operation of the corresponding sprinkler nozzle 2 and water mist nozzle 3 is sequentially stopped.

When it is discriminated that the operation of all of the operating sprinkler nozzles 2 and water mist nozzles 3 is stopped (SP29-YES), the operation of the apparatus is ended.

The above operation is the processing operation related to the temperature detection caused by the occurrence of a fire.

On the other hand, in the above supervisory loop, when the smoke density signal which exceeds the operation start density due to the occurrence of a fire is input (SP3-YES), the position of the density detecting sensor 7 which has output the smoke density signal is specified (SP20).

For example, supposing that the smoke detecting sensor 7 outputs the temperature detecting signal, the water mist nozzle 3*a* of the smoke density sensor 7*a* part is operated (SP21). The operation is performed with the valve opening and closing mechanism 3M of the water mist nozzle 3*a* part controlled to open.

Subsequently, the control means 21 extracts the numbers of the nozzles of the positions near and distant from the specified water mist nozzle 3*a* with reference to the described preset content from the storage part 22 (SP22). In the example, the water mist nozzles 3*b*, 3*c*, 3*d*, 3*e*, 3*g* are extracted, and the valve opening and closing mechanisms 3M thereof are controlled to open (SP23).

Thus, smoke eliminated by the water mist nozzles 3 in the surroundings of the place 3*a* with high smoke density.

It is transmitted to SP27, and concerning the smoke sensors 7 of the respective places where the water mist nozzles 3 are operating, it is judged whether a smoke density detection signal is below a designated density (e.g. when it reaches a designated density lower than the density detected at the time of starting the operation) or not (SP27). When one of the smoke sensors 7 is below a designated density (SP27-YES), the operation of the water mist nozzles 3 of the smoke density sensor 7 part is stopped (SP28).

Hereinafter, when the smoke density signals of the respective smoke density sensors 7 are below a designated density, the operation of the corresponding water mist nozzles 3 is sequentially stopped.

When the operation of all of the water mist nozzles 3 is stopped (SP29-YES), the operation of the apparatus is ended.

In the described construction, the sprinkler nozzles 2 are immediately operated in the place where a fire is caused to execute full-scale fire extinguishing. Further, in the surroundings thereof, the water mist nozzles 3 are operated to execute the operation of preventing the spread of a fire.

As described above, the fire extinguishing work is conducted not only by the operation of the sprinkler nozzles 2, but in a little distant place, the water mist nozzles 3 are operated. Thus, damage by water can be reduced without lowering of fire extinguishing efficiency and without increase in the quantity of water used.

In the case where there are provided closing means for preventing the spread of a fire such as letting down a fire shutter when the occurrence of a fire is detected, the means may be jointly operated. In this case, it is possible that the sprinklers are operated on the side where a fire is caused, and on the opposite side (that is, in a little distant place), the water mist nozzles 3 are operated.

If the spread of a fire is expanded, the sprinkler nozzles 2 in the place where the temperature rises corresponding to the expansion are operated to execute full-scale fire extinguishing work.

Another example of configuration of the centralized control device 20 will now be described.

In the storage part 22, the preset content shown in a virtual diagram of FIG. 9 is stored.

As shown in the drawing, the numbers of the sprinkler nozzles 2 and the numbers of the water mist nozzles 3 in the places where the respective temperature detecting sensors 5 are arranged are set and stored in a tabular format.

For example, in the case of constitution shown in FIG. 1(*a*), the sprinkler nozzle 2*a* and the water mist nozzle 3*a* are arranged in the temperature detecting sensor 5*a* part.

The operation start temperature for operating the water mist nozzle 3*a* is previously set in the processing means 21.

Figure 10:
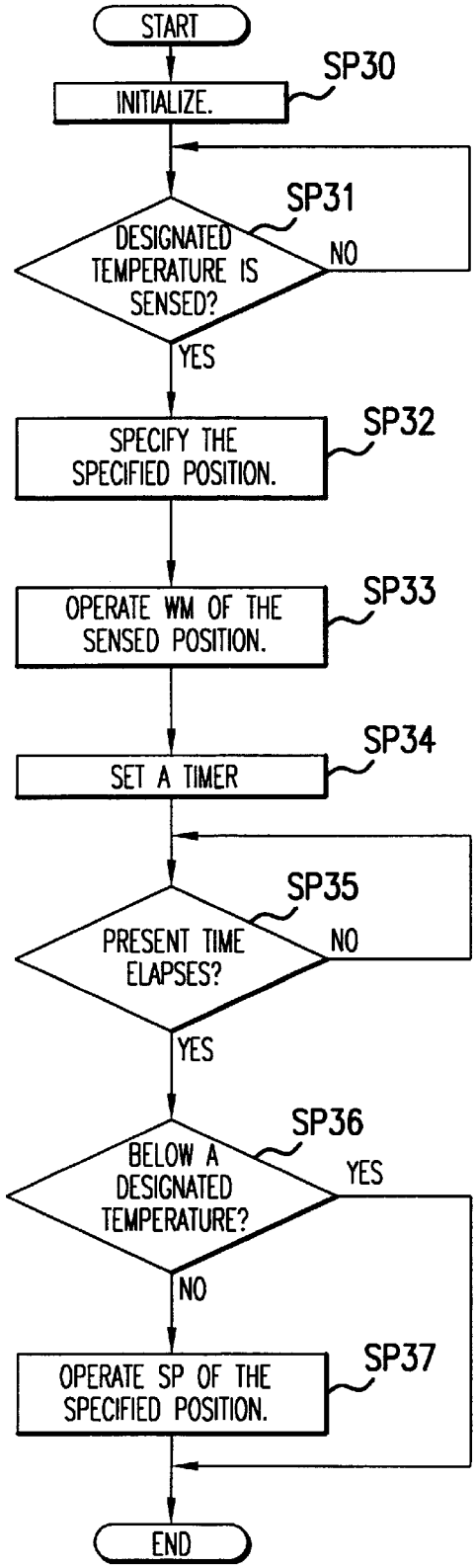
FIG. 10 is a flowchart showing another control content of the centralized control device.

The example of operation from the supervisory operation~execution of spraying by the centralized control device 20 will now be described by using a flowchart of FIG. 10.

First, initialization (SP30) with the operation start of the control means 21 is performed.

Subsequently, it is sensed whether a temperature detection signal from each temperature detecting sensor 5 exceeds the above operation start temperature or not (SP31).

Here, if a temperature detection signal which exceeds the operation start temperature due to the occurrence of a fire is input (SP31-YES), the position of the temperature detecting sensor 5 which has output the temperature detection signal is specified (SP32).

For example, supposing that the temperature detecting sensor 5*a* outputs the temperature detection signal, the water mist nozzle 3*a* of the temperature detecting sensor 5*a* part is operated (SP33). The operation is performed with the valve opening and closing mechanism 3M of the water mist nozzle 3*a* part controlled to open.

Thus, in the place where a fire is caused, in the beginning, fire extinguishing by the water mist nozzle 3*a* is started.

The amount of time elapsed from the start is clocked by a timer in the interior of the control means 21 (SP34), and when designated time elapses, the state of a fire is again supervised (loop processing of SP35).

To be concrete, concerning the temperature detecting sensor 5*a* of the water mist nozzle 3*a* which is now operating, it is judged whether the temperature detection signal is below the designated temperature or not (SP36).

If below the designated temperature (SP37-YES), the centralized control device 20 ends the operation start processing, and fire extinguishing work is continued. The fire extinguishing work is stopped according to the confirmation of extinguishment of a fire by operating the input part 26 to stop the device 20 or by closing a faucet.

However, if is above designated temperature in the step SP36 (SP36-No), it is decided that the strength of a fire is not slacken in the place, and the sprinkler nozzle 2*a* in the place is operated (SP37) to start full-scale fire extinguishing work.

Thus, in the initial stage of the occurrence of a fire, the water mist nozzles 3 are used to efficiently extinguish the fire so that the quantity of water used can be decreased and the damage by water can be reduced.

In the case where the strength of a fire can not be slackened by fire extinguishing using the water mist nozzles 3, however, the operation of the sprinkler nozzles 2 is also started to start full-scale fire extinguishing work.

In the described operation, the second temperature detecting operation after the lapse of designated time in the steps SP34 to SP36 may be omitted. That is, the steps SP34 and 35 may be omitted and in the step SP36, lowering of a temperature detection signal after the start of operation may be continuously detected. On the other hand, the step SP36 may be omitted and after clocking in the steps SP34 and 35, the operation of the sprinkler nozzles 2*a* is necessarily started.

In the step SP37, the operation of the sprinkler nozzle 2*a* is started, and the water mist nozzle 3*a* operated at this time may be stopped. That is, at the time of full-scale fire extinguishing, fire extinguishing using the sprinkler nozzle 2*a* is more effective than that using the water mist nozzle 3*a*. Since the volume of water kept in store of a water source (water supply tank T) is limited, in some case, the supply of water to the sprinklers and the surrounding water mist nozzles is more useful in full-scale fire extinguishing by stopping the water mist nozzle 3*a*.

These settings can be changed by manual operation of the input part 26 in the initialization to the centralized control device or even after the start of fire extinguishing.

The sprinkler nozzle 2 described in the above embodiment can be replaced by water spray equipment and another water discharge equipment using water. Further, instead of water, a chemical fire extinguisher such as Halon or the like can be used (of course, in this case, instead of the water supply tank T, a fire extinguisher storage equipment such as a bomb or the like is provided). Further, another fire extinguish equipment is adopted to be used jointly with the water mist nozzle 3.

In either case, the fire extinguish equipment using the water mist nozzle 3 and another fire extinguish equipment using the sprinkler nozzle 2 can be arranged in positions suitable for execution of fire extinguishing. These are operated in combination according to the state of a fire to enable the described initial fire extinguishing and transition to full-scale fire extinguishing work. This can produce the similar working effect in smoke eliminating as well as in fire extinguishing.

In the above embodiment, spraying of the sprinkler nozzle 2 and the water mist nozzle 3 is controlled by the centralized control device 20 in one place. This is not restrictive, but spraying can be controlled by each of the dispersed control devices.

The description deals with the construction where the sprinkler nozzle 2 and the water mist nozzle 3 are respectively provided with valve opening and closing mechanisms 2M, 3M. The valve opening and closing mechanisms 2M, 3M, however, may be disposed not only in the nozzle part but in the midway of a passage.

Second Embodiment

A second embodiment of the present invention will now be described.

In the above embodiment, the water mist nozzle 3, the sprinkler nozzle 2 and the other fire extinguishing equipment are used jointly. In the present embodiment, two different systems of water mist nozzles 3, 13 corresponding to two different types of combustible materials are adopted. In the following description, lamp oil and wood are cited as an example of two types of combustible materials.

Figure 11:
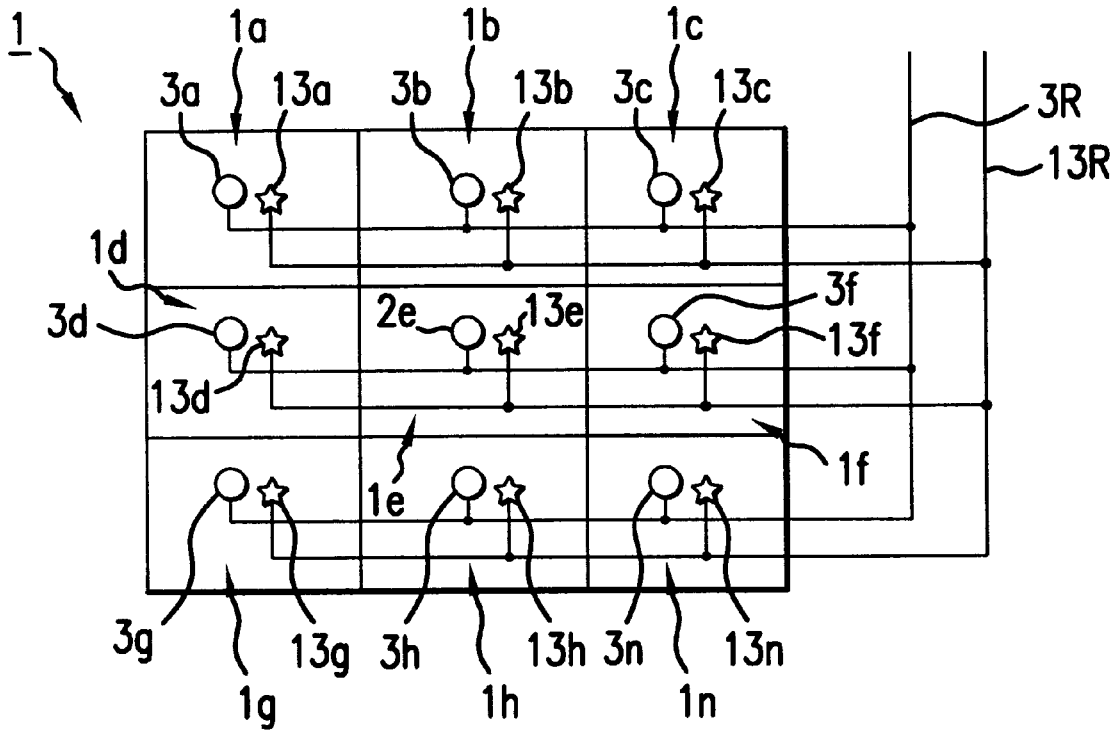
FIG. 11 is a diagram showing a second embodiment of the present invention, which is a plan view showing the arrangement of water mist nozzles of a different system in a room.

FIG. 11 is an arrangement plan of a fire extinguishing and smoke eliminating apparatus using a water mist in the second embodiment.

As a fire extinguishing section, plural rooms (1*a* to 1*n*) are shown in the drawing. Each room 1*a* to 1*n* is one closed space, the periphery of which is closed by walls and doors.

Two different types of water mist nozzles 3, 13 are arranged in the ceiling of each room. The water mist nozzle 3 is used for fire extinguishing and smoke eliminating for lamp oil, and the water mist nozzle 13 is used for fire extinguishing and smoke eliminating for wood. The types of the water mist nozzles 3, 13 of the respective systems for fire extinguishing and smoke eliminating for these different objects are respectively set by the objects.

The water mist nozzles 3*a* to 3*n* in one type are connected to a water source such as a water supply tank or the like through a passage 3R.

The water mist nozzles 13*a* to 13*n* in the other type are connected to a water source such as a water supply tank or the like through a passage 13R, whereby a designated quantity of water at a designated pressure is supplied.

Figure 12:
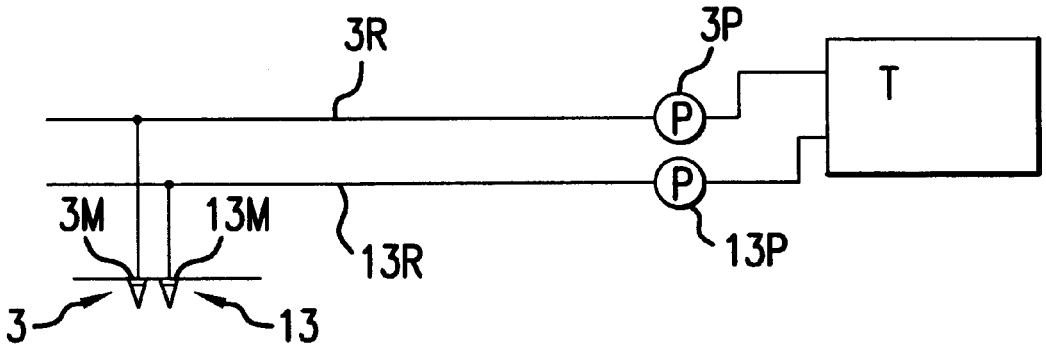
FIG. 12 is a diagram showing the connecting structure of a passage and a water supply tank of the above embodiment.

FIG. 12 is a diagram showing another constitution of a passage R. Water from a water supply tank T is supplied to water mist nozzles 3, 13 shown in FIG. 11 through respective different passages 3R, 13R as shown in FIG. 11.

In the above example of constitution, two different types of water mist nozzles 3, 13 adjacent to each other are provided in a pair. This is not restrictive, but as shown in FIGS. 1(*b*) and (*c*) of the first embodiment, they may be arranged by plurals.

The respective water mist nozzles 3, 13 are controlled to open and close spraying by the valve opening and closing mechanisms 3M, 13M. The valve opening and closing mechanisms 3M, 13M are controlled to open and close in the center.

The constitution of the operation control will now be described.

Figure 13:
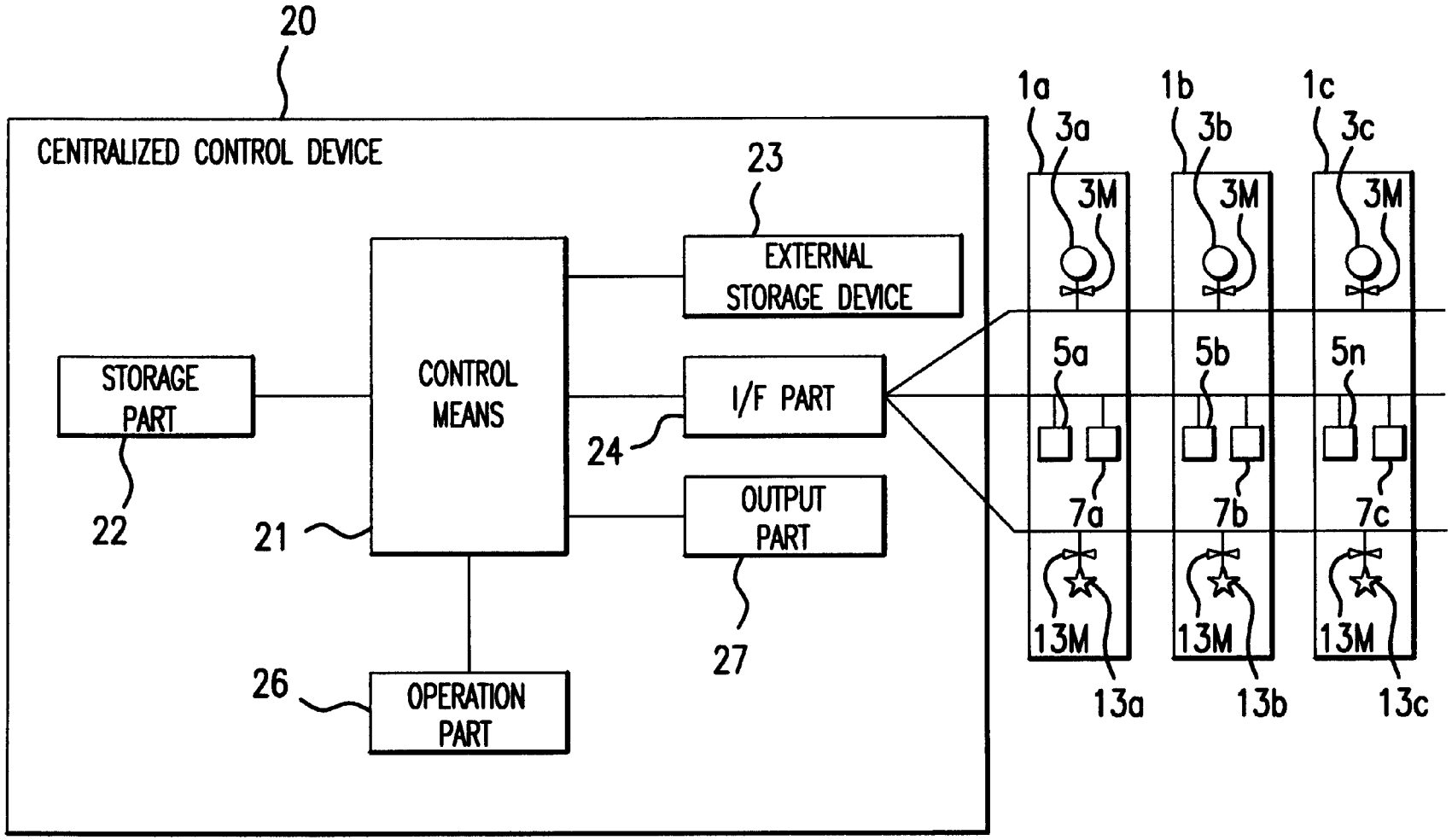
FIG. 13 is a circuit diagram showing a control system of a centralized control device of the above embodiment.

FIG. 13 is a circuit diagram showing a control system of the above fire extinguishing and smoke eliminating apparatus.

Spraying from the water mist nozzles 3, 13 provided in the respective rooms 1 (1*a* to 1*n*) shown in FIG. 11 is controlled by a centralized control device 20. The centralized control device is formed by the same hardware as that shown in the first embodiment (FIG. 6).

The centralized control device 20 is so constructed that control means 21 such as CPU or the like executes the supervisory operation mentioned later according to the operation program stored in a storage part 22 such as ROM, RAM or the like. The supervisory information at the time of executing the supervisory operation is stored in an external storage device 23.

A temperature detection signal of the temperature detecting sensor 5 and a smoke density signal of the smoke detecting sensor 7 are respectively input to the interface part (I/F part) 24, and output to the control means 21.

A plurality of temperature detecting sensors 5 (5*a*–5*n*) and smoke detecting sensors 7 (7*a*–7*n*) are disposed adjacent to the respective water mist nozzles 3, 13 parts provided in the room 1.

The I/F part 24 selectively controls the valve opening and closing mechanisms 3M, 13M of the corresponding water mist nozzles 3, 13 to open and close at the time of inputting a control signal for execution of spraying by the control means 21.

The temperature detecting sensor 5 and the smoke detecting sensor 7 form detecting means for detecting a fire. The valve opening and closing mechanisms 3M, 13M form operating means for starting spraying.

The input part 26 is formed by a keyboard for setting the operation of the centralized control device 20 and operating execution of spraying by manual operation and a receiving part for receiving operation instructing information from the outside through a line or the like at need.

The output part 27 is formed by a display device for displaying the supervisory operating condition, an external output device for sending information to disaster prevention service or the like when the temperature is detected, and a printer for printing the history of supervisory information.

FIG. 14 is a virtual diagram showing the preset content stored in the storage part 22.

As shown in FIG. 14(*a*), the numbers of the temperature detecting sensor 5, the smoke detecting sensor 7 and the water mist nozzles 3, 13 arranged in each room 1 are set and stored in such a manner as to have a correspondence between them.

Further, in FIG. 14(*b*), the types of the objects stored in each room are set and stored in such a manner as to have a correspondence between them.

Further, in FIG. 14(*c*), the types of water mist used by objects, the operation start temperature by water mist nozzles of the respective types, and the operation start smoke density are set and stored in such a manner as to have a correspondence between them.

The respective files of the above shown in FIGS. 14(*a*)–14(*c*) are connected to each other by hierarchical structure, and for example, the files of FIGS. 14(*a*) and 14(*b*) are connected to each other taking the room number as a reference. The files of FIGS. 14(*b*) and 14(*c*) are connected to each other taking an object as a reference, and the further detailed preset content can be referred, and setting can be updated by changing the reference.

For example, according to FIG. 14(*a*), it is set that the temperature detecting sensor 5*a* and the smoke detecting sensor 7*a* are arranged in the water mist nozzles 3*a*, 13*a* parts provided in the room with a number 1*a* (See FIG. 11 and FIG. 13). In FIG. 14(*b*), it is set that wood is stored, and according to FIG. 14(*c*), it is set that fire extinguishing and smoke eliminating for the wood are performed by use of one water mist nozzle 3*a*. Simultaneously, concerning the wood, the temperature for detecting (a fire) by the temperature detecting sensor 5*a* is a designated temperature X1. The smoke density for detecting (a fire) by the smoke detecting sensor 7*a* is set to a designated density Y1.

For the purpose of making the processing flexible, the described set information may be changed except the execution of spraying (even during operation at need) according to an instruction from the input part 26.

The operation of the apparatus in the configuration of the second embodiment will now be described.

Figure 15:
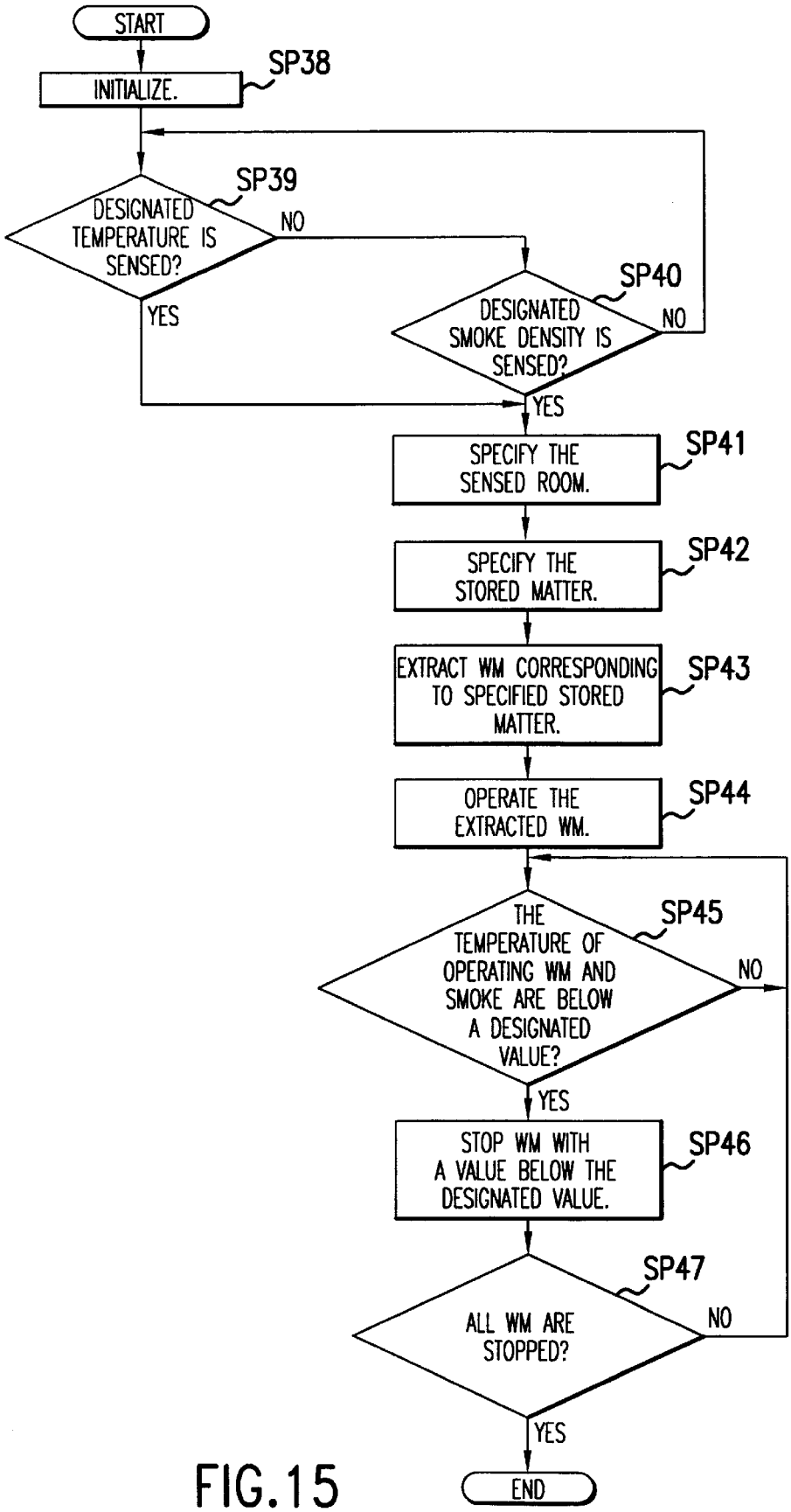
FIG. 15 is a flowchart showing the control content of the centralized control device of the above embodiment.

FIG. 15 is a flowchart showing the operation from the supervisory operation—execution of spraying—end by the centralized control device 20.

First, initialization (SP38) with the operation start of the control means 21 is performed.

Supervisory operation on occurrence of a fire will be described hereinafter.

In supervision, executed is a supervisory loop for cyclically detecting either whether a temperature detection signal from each temperature detecting sensor 5 exceeds the above operation start temperature or not (SP39), or whether a smoke density signal from each smoke detecting sensor 7 exceeds the operation start density or not (SP40).

The execution processing will be described by way of concrete examples. The control means 21 specifies (SP41) the position of the temperature detecting sensor 5 which has output a temperature detection signal when a temperature detection signal indicating that it exceeds the operation start temperature X1 is received from a certain temperature sensor 5 (SP39-YES). For example, when the temperature detecting sensor 5*a* outputs the temperature detection signal, it is specified that a fire is caused in the room 1*a* according to the files of FIGS. 14(*c*) and (*a*).

Subsequently, according to the file of FIG. 14(*b*), it is specified that an object of the room 1*a* is wood (SP42).

According to the file of FIG. 14(*a*), it is judged that the water mist nozzle 3*a* is used for extinguishing a fire for wood in the room 1*a* (SP43).

Thus, in the room 1*a*, the operation of the water mist nozzle 3*a* corresponding to the wood of the object is started (SP44). The operation is performed with the valve opening and closing mechanism 3M of the water mist nozzle 3*a* controlled to open.

In the case where there are provided plural water mist nozzles 3*a* for extinguishing a fire for wood in the room 1*a,* the plural water mist nozzles 3*a* may be operated at the same time. In this case, fire extinguishing by plural water mist nozzles 3*a* is started in the room 1*a*.

Subsequently, concerning the temperature detecting sensor 5*a* of the room 1*a* where the water mist nozzle 3*a* is now operated, it is judged whether a temperature detection signal is below a designated temperature (e.g. when it reaches a designated temperature lower than the temperature detected at the time of starting the operation) or not (SP45).

When the temperature detecting sensor 5 is below a designated temperature (SP45-YES), the valve opening and closing mechanism 3M of the water mist nozzle 3*a* of the room 1*a* is closed to stop the operation (SP46).

When it is judged that the operation of all of the operating water mist nozzles 3 is stopped (SP47-YES), the operation of the apparatus is ended.

The above operation is the processing operation related to temperature detection caused by the occurrence of a fire from wood. In the described supervisory loop, even in the case where a smoke density signal which exceeds the operation start density is input due to the occurrence of a fire from wood (SP40-YES), similarly concerning the density detecting sensor 7 which has output the smoke density signal, the position of the room is specified. Then, the operation of the corresponding water mist nozzle 3 is started.

In the following, concerning the smoke sensor 7 of each place of the water mist nozzle 3 operated in the similar processing, it is judged whether a smoke density signal is below a designated density (e.g. when it reaches a designated density lower than the density detected at the time of starting the operation) or not (SP45). When one of the smoke sensors 7 is below a designated density (SP45-YES), the operation of the water mist nozzle 3 of the smoke density sensor 7 part is stopped (SP46). When a smoke density signal of each smoke density sensor 7 is below a designated density, the operation of the corresponding water mist nozzle 3 is sequentially stopped.

When it is judged that the operation of all of the operating water mist nozzles 3 is stopped (SP47-YES), the operation of the apparatus is ended.

In the above description, the wood as an object reaches a designated temperature or a designated smoke density due to a fire, and the corresponding water mist nozzle 3 for wood is operated to extinguish a fire and eliminate smoke. Similarly, when lamp oil as an object reaches a designated temperature X2 or a designated smoke density Y2 due to a fire (See FIG. 148*c*) in the supervisory loop, fire extinguishing and smoke eliminating are started by the water mist nozzle 13 which is another system.

Thus, different water mist nozzles 3, 13 are used by the types of objects, whereby fire extinguishing and smoke eliminating suitable for an object can be performed.

Not only the object itself, but the direction from which smoke flows is grasped to specify an object, and the water mist nozzle corresponding to the object may be used. Further, in the case where the type of smoke can be specified by the smoke sensor or the like, the water mist nozzle corresponding to the smoke may be used.

The relationship between various types of objects and the water mist nozzles will now be described by way of an experimental example.

Figure 16:
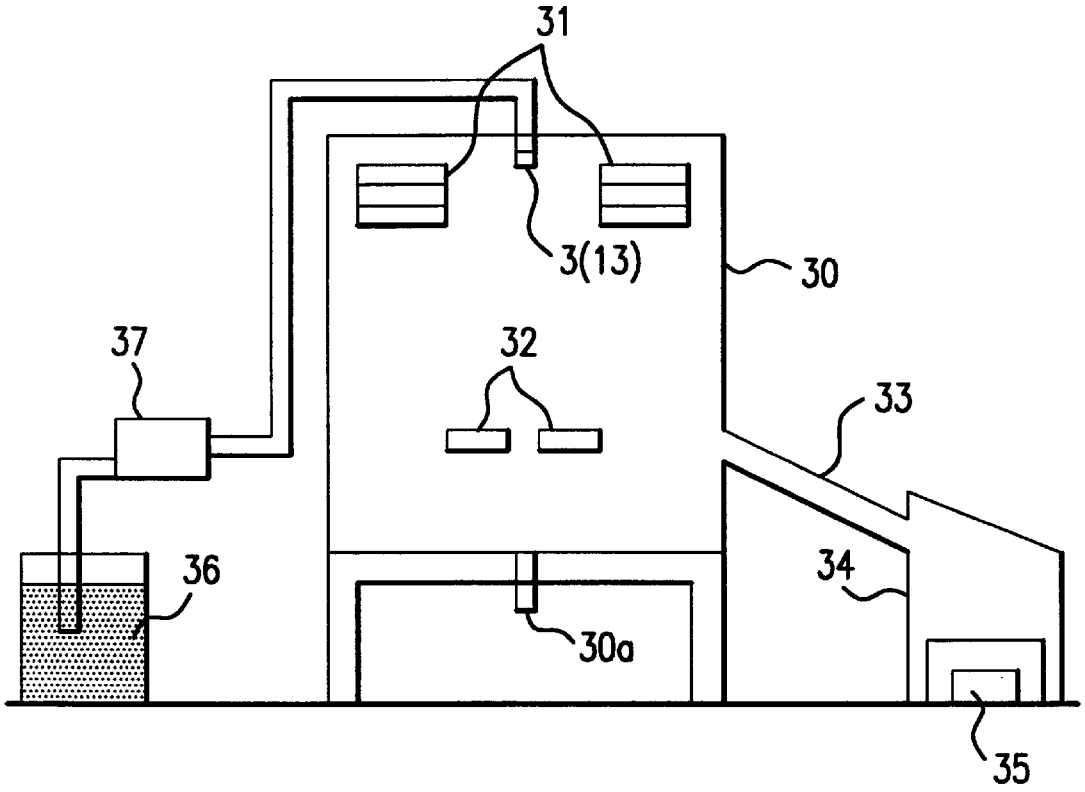
FIG. 16 is a diagram showing an experimental apparatus according to the second embodiment.

FIG. 16 is a diagram showing an experimental apparatus. A smoke collecting box 30 is a box formed by covering the surface of a cube, one side of which is 1.5 m with an iron plate. Two fans 31 and a smoke-density member 32 having a light emitting part and a photo detecting part are installed in the interior of the smoke collecting box 30. A drain hole (ϕ65) 30*a* is bored in the central part of the base. Smoke from a hood is introduced into the smoke collecting box 30 through a duct (with a damper) 33. At this time, the fans 31 are operated until the smoke collecting box 30 is filled with smoke.

A burning tray 35 for lamp oil or wood chips used as an object is disposed below the box 30. The ceiling of the hood 34 is provided with a water mist nozzle 3 (or 13), thereby sending out water from a water storage tank 36 by a pump 37 at a designated pressure as spray to the interior of the smoke collecting box 30.

The nozzle of the water mist nozzle 3 used is a hollow cone type and the spray angle is about 80 degrees. Water used is service water.

The smoke eliminating effect in burning lamp oil and smoking wood is tested by the above experimental apparatus. The experiments are, as shown in a combination table of FIG. 17, made with different nozzles 5A to 35A in combination with different spray pressure ranging from 1 to 10 kgf/cm$^2$. In the diagram, ○ indicates a combination in an experiment on lamp oil and Δ indicates a combination in experiment on wood.

In the following, among the respective experimental values, the result of a combination of the nozzle and pressure by which a designated smoke eliminating effect is produced at the time of burning lamp oil and the result of a combination of the nozzle and pressure by which a designated smoke eliminating effect is produced at the time of smoking wood are extracted and described. The experiments are made on both lamp oil and wood under the same conditions (nozzle and pressure).

Figure 18:
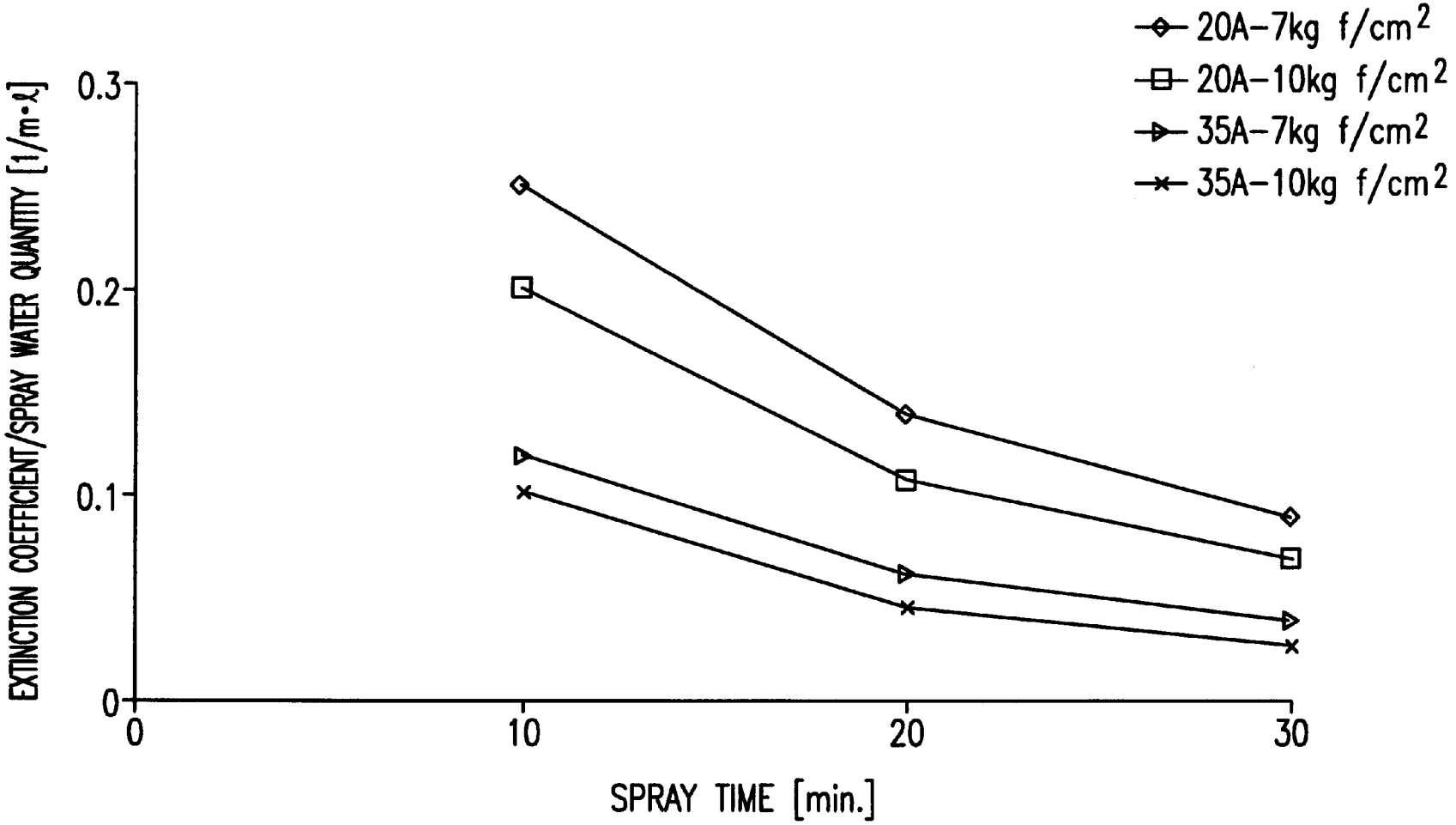
FIG. 18 is a diagram showing the smoke eliminating effect at the time of lamp oil burning in the above experimental apparatus.

FIG. 18 is a diagram showing the smoke eliminating effect (extinction coefficient decrease efficiency) at the time of burning lamp oil in the above experimental apparatus. The extinction coefficient shows the transmissivity of light which is used as an index for the density of smoke. In the table 2, an arithmetic expression for the extinction coefficient is shown.

TABLE 2

$$\text{Extinction coeffcient (Cs)} = \frac{1}{d}\log e\frac{I_o}{I}\ (m^{-1})$$

Io: scale reading by indicator when there is no smoke.
I: scale reading by indicator when there is smoke.
d: measured optical path length (m)

The axis of abscissas of FIG. 18 indicates the spray time of the water mist nozzle 13 for lamp oil, and the axis of ordinates indicates the extinction coefficient/spray water quantity. The extinction coefficient decrease efficiency is expressed by the change quantity/water quantity to the initial value of the extinction coefficient.

When in the above experiment, as the types of the water mist nozzles 13, the nozzles used are 20A and 35A (A indicates the article number), and spraying is performed at hydraulic pressure of 7 kgf/cm$^2$ and 10 kgf/cm$^2$, a predetermined smoke eliminating effect is obtained. The smoke eliminating effect of this combination is extracted and described in FIG. 18.

500 cc of lamp oil is put in an iron-made burning tray 35 and ignited, and a damper of a duct 33 and a drain hole 30*a* are opened, and closed at the end of burning lamp oil to prevent outflow of smoke. The experiment is started when the smoke density in the smoke collecting box 30 shows the highest value. Spraying is performed by ten minutes, for thirty minutes in total. In the beginning, spraying is performed for ten minutes, and after that, spraying is discontinued for one minute. In the meantime, the smoke density is measured by a smoke-density meter 32. Both of two fans in the smoke collecting box 30 are rotated while the extinction coefficient is increased (combustible material is in the course of burning) and at the time of measurement using the smoke-density meter 32 after ten minutes' spraying to make the smoke density uniform. The reason why the fans are stopped during spraying mist is that an air current produced by the fans has no influence on spraying.

According to the result of experiments, as the water mist nozzle 13 effective for smoke eliminating at the time of burning lamp oil, the highest smoke eliminating efficiency is shown on condition that the nozzle is 20A and the hydraulic pressure is 7 kgf/cm$^2$. Nozzles with conditions of 10 kgf/cm$^2$ in 20A, 7 kgf/cm$^2$ in 35A, and 10 kgf/cm$^2$ in 35A follow the above nozzle. The experiment result reveals that if an object is lamp oil, the water mist nozzle 13 which is a nozzle 20A and operated at hydraulic pressure of 7 kgf/CM$^2$ is most effective.

Figure 19:
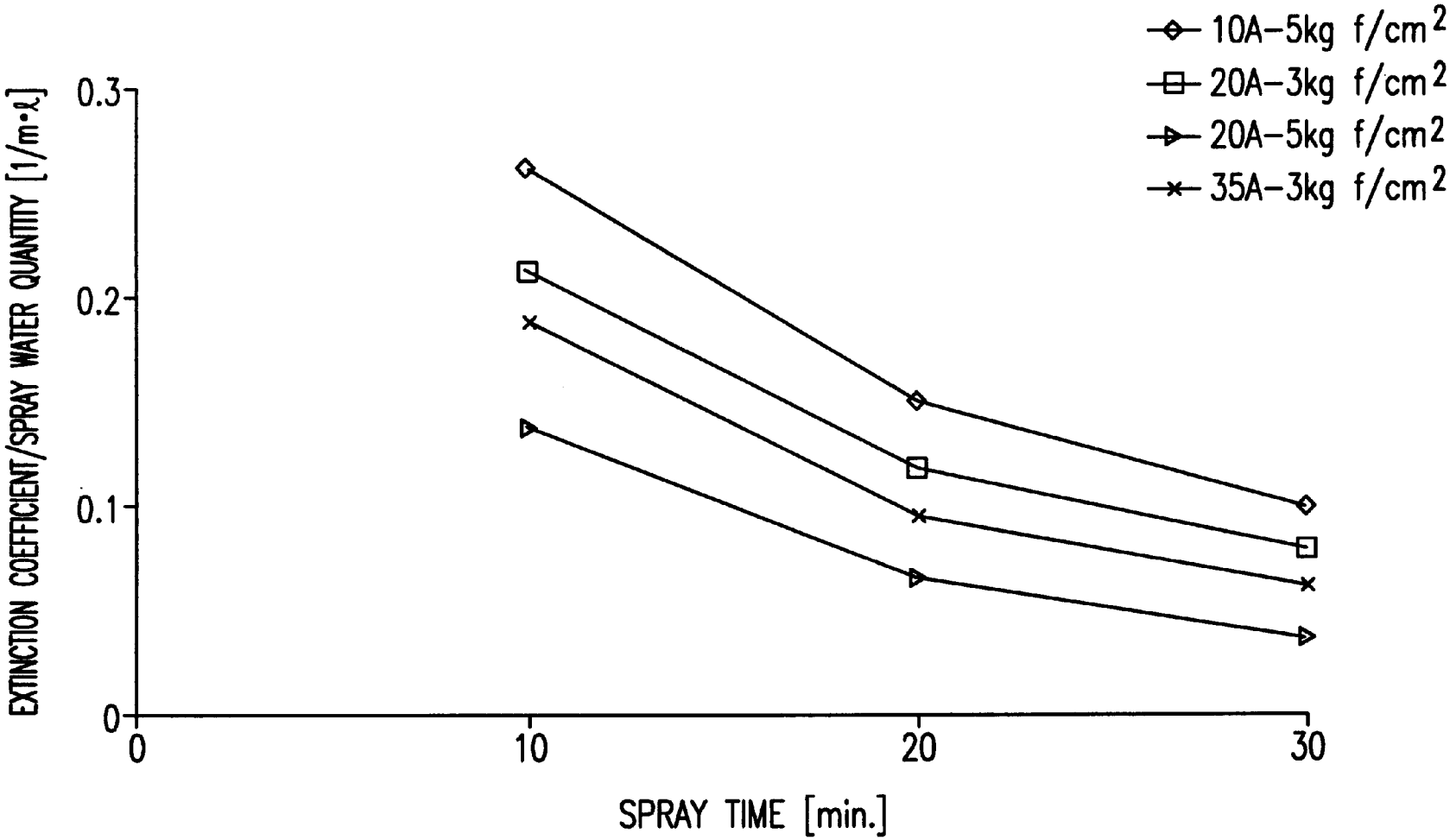
FIG. 19 is a diagram showing the smoke eliminating effect at the time of wood smoking in the above experimental apparatus.

FIG. 19 is a diagram showing the smoke eliminating effect (extinction coefficient decrease efficiency) at the time of smoking wood in the experimental apparatus similar to the above. As wood to be used, 300 g of wood chips are dried at 60° C. in a thermostatic chamber for 24 hours, and smoked by an electric hot plate below the hood 34 to emit smoke.

According to the above experiment, when as the types of the water mist nozzle 3 to be used, the nozzles are 10A, 20A, 35A (A indicates an article number), spraying is performed at hydraulic pressure of 3 kgf/cm$^2$ and 5 kgf/cm$^2$, a predetermined smoke eliminating effect can be obtained. The smoke eliminating effect of this combination is extracted and described in FIG. 19.

As the result of the experiment, the water mist nozzle 3 effective for eliminating smoke for wood shows the highest smoke eliminating effect with conditions of a nozzle 10A and hydraulic pressure of 5 kgf/cm$^2$. Nozzles with conditions of 3 kgf/cm$^2$ in 20A, 5 kgf/cm$^2$ in 20A, and 3 kgf/cm$^2$ in 35A follow the above nozzle. According to the experiment result, if an object is wood, the water mist nozzle 3 which is a nozzle 10A and operated at hydraulic pressure of 5 kgf/cm$^2$ is most effective.

According to the above experiment results, the optimum conditions (nozzle 20A, hydraulic pressure of 7 kgf/cm$^2$) as the water mist nozzle 13 used for lamp oil and the optimum conditions (nozzle 10A, hydraulic pressure of 5 kgf/cm$^2$) as the water mist nozzle 3 used for wood are different in both the nozzle type and the hydraulic pressure.

As described in the second embodiment, the smoke eliminating effect can be obtained early by spraying fine water particles on conditions according to the type of the object. Simultaneously, it is possible to hold down damage by water to the minimum at the time of fire extinguishing and smoke eliminating for an object by spraying optimum fine water particles with the nozzle and hydraulic pressure according to the type of the object.

In the above experiment, the results are obtained within the range of conditions of limiting the nozzle and the hydraulic pressure, which does not mean that only the above experiment results are effective. The above conditions vary with the environment, the object and the change on the object side such as a difference in section, so that another nozzle sometimes becomes effective. Accordingly, if an object is different, all are not always set to the same conditions, and it is necessary to select the optimum within the selective range.

In the above second embodiment, two different water mist nozzles 3, 13 are provided according to objects in each room 1. If fine water particles effective for fire extinguishing and smoke eliminating for these different objects can be sprayed by one water mist nozzle, however, it may be sufficient to install only one water mist nozzle of this type in the room 1 (e.g. the following two fluid nozzle). In this case, the described hydraulic pressure can be switched to be different depending on the respective objects and supplied to the water mist nozzle.

The respective water mist nozzles 3, 13 are adapted to spray fine water particles at different hydraulic pressures and through different passages depending on the object, but this is not restrictive. That is, the two fluid nozzle is adapted to spray water with gas. A predetermined pressure is applied to water and gas, respectively, to spray fine water particles from one nozzle. In the two fluid nozzle, the particle diameter is determined by the ratio of air quantity to water quantity, that is, the gas-liquid ratio. If the two fluid nozzle of this type is used, fine water particles different in particle diameter can be sprayed from the two fluid nozzle to which different gas pressure is applied even on one passage for water.

Though the description deals with the case where an object is stored in each room 1, the same working effect can be obtained even in the case where an object is not stored, but temporarily exists therein.

Further, in the above description, smoke generated from different types of objects is detected, and the water mist nozzles 3, 13 suitable for the smoke are selectively operated. This is not restrictive, but the smoke detecting sensor 7 detects the smoke itself, and fine water particles with a designated particle diameter suitable for the smoke of this type can be sprayed from the water mist nozzle by the centralized control device 20.

Third Embodiment

A third embodiment of the present invention will now be described. In the present embodiment, the same reference numerals are given to the same structural parts as those of the above embodiments, and the description is omitted.

When a fire is caused, in its initial stage, the temperature is so high that the smoke rises and the vicinity of the ceiling of the room is filled with the smoke. But there is little smoke on the floor side (lower position), which results in the so-called two-layer state.

Accordingly, in the present embodiment, the water mist nozzle 3 (or 13) is arranged in such a manner that the height position of a nozzle orifice for spraying water mist is lower than the height position of the ceiling. That is, a designated distance is provided between the nozzle orifice and the ceiling.

Figure 20:
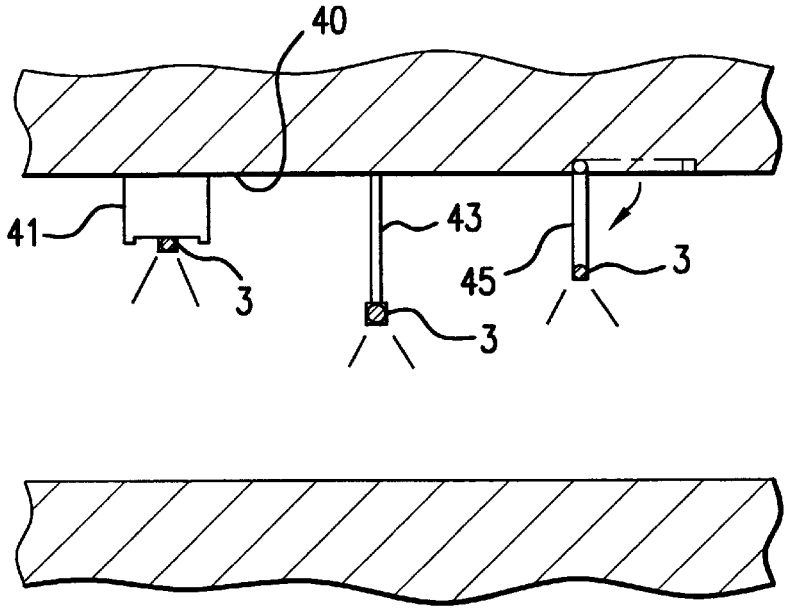
FIG. 20 is a schematic diagram showing a third embodiment of the present invention.

For example, as shown in the schematic diagram of FIG. 20, a water mist nozzle 3 is arranged on the lower surface of a beam 41 of the ceiling 40. A support member 43 with a designated length is suspended from the ceiling 40, and the water mist nozzle 3 is arranged on the end part of the support member 43, thereby spraying fine water particles downwards.

In addition to the above, the water mist nozzle 3 may be arranged on the free end part (the forward end during rotation) of a smoke stopping pendent wall 45 which is provided on the ceiling 40 and is turned from the ceiling surface position to the vertical position to be projected when a fire is caused, thereby spraying downwards.

Further, the support member 43 may be expanded from the ceiling to the lower side, whereby the height position of the water mist nozzle 3 can be freely varied to spray downwards.

Further, the water mist nozzle 3 is not always suspended from the ceiling. For example, it may be provided at a designated height from the ceiling position of the wall to spray laterally from the wall, or it may be provided on the floor to spray upwards.

No limits is set to the place for arrangement, including the place for arrangement except the above, and the height position of the nozzle orifice is at a designated height below the ceiling surface.

For example, the described pendent wall 45 is set to be projected downward from the ceiling surface by 50 cm or more. When a fire is caused, the pendent wall 45 is suspended vertically, whereby the smoke is intercepted by the pendent wall 45 part, and the smoke is prevented from flowing further far away or delayed.

Accordingly, in the initial stage of a fire, the smoke tends to stay on the ceiling side from the forward end position of the pendent wall 45. On the other hand, the smoke tends to little stay below the pendent wall 45. For the described reason, the water mist nozzle 3 is provided on the free end part of the pendent wall 45.

If the pendent wall 45 is not provided, the smoke is not intercepted to flow further far away. Accordingly, in the initial stage of a fire, the thickness of staying smoke (thickness, with respect to the ceiling surface as a reference) is smaller as compared with the case where the pendent wall 45 is provided.

Thus, the nozzle position of the water mist nozzle 3 in a section without the pendent wall 45 may be higher than that in the section with the pendent wall 45.

If the water mist nozzle 3 is operated in the initial stage of a fire, when fine water particles are sprayed from the nozzle orifice of the water mist nozzle 3, the smoke below the nozzle orifice can be eliminated concentratively more than the smoke spread in the vicinity of the ceiling. Thus, smoke eliminating is performed for the lower layer part of the smoke which is in the two-layer state in the initial stage of a fire by the water mist nozzle 3, so as to heighten the effect of escaping without being overwhelmed by smoke in the initial stage of a fire.

According to the form of a ceiling or the generation state of smoke, in some cases, some of fine water particles sprayed from the water mist nozzle 3 eliminate the smoke of the upper layer part.

The nozzle orifice of the water mist nozzle 3 can be installed on the floor surface as the lower limit of installation height. When a fire escape is taken into consideration, generally if it is about above the position of a person's face (it is different between the case of escape in a crawling posture and the case of escape in an erected posture, for example, 50 to 180 cm), the nozzle orifice will not be an obstacle to escape. At the lowest, it will be sufficient to perform smoke eliminating for the range of near the escaping person's face or height equivalent to the vicinity of the face. That is, if the smoke is poisonous, the poison can be avoided by smoke eliminating for the vicinity of the face, and the visibility at the time of a fire escape can be secured by smoke eliminating in the range of height equivalent to the vicinity of the face.

The exhibition of the effect can be expected in the following places in addition to the constitution of the above respective embodiments by fire extinguishing and smoke eliminating using water mist.

As a small quantity of water is sprayed as the water mist, damage by water can be reduced. Accordingly, in a certain fire extinguishing section, the water mist nozzle 3 (13) is arranged in the place where goods such as electric products susceptible to damage by water are arranged. Thus, the goods can be expected not to be subjected to damage by water.

Fourth Embodiment

Figure 21:
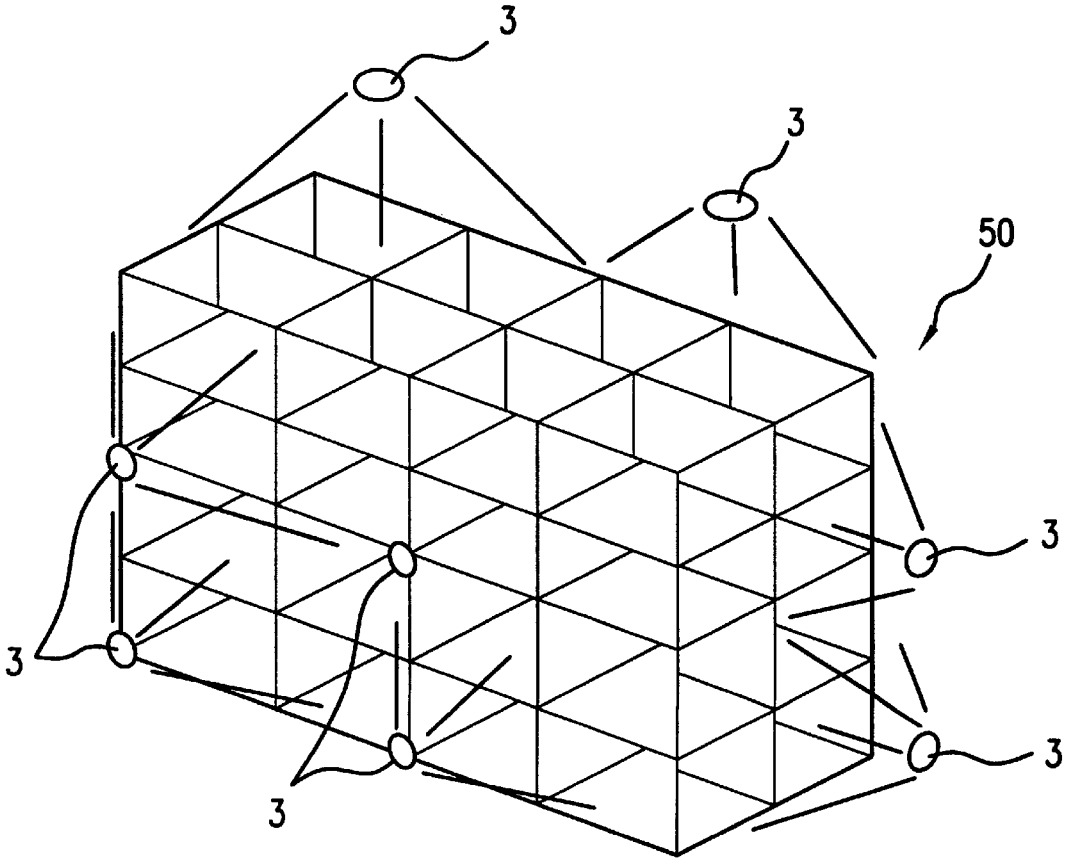
FIG. 21 is a perspective view showing a fourth embodiment of the present invention.

FIG. 21 is a perspective view showing a fourth embodiment of the present invention. As shown in the drawing, a rack 50 having plural shelves in the direction of height is provided in a section as an object for fire extinguishing. The rack 50 is, for example, a shelf of a storehouse, or a bicycle storage space, and formed by assembling plural support members like a grid, the upper side and the side part being opened.

The rack 50 is not always like a grid, but in some cases, it comprises the minimum number of longitudinal members for supporting a shelf. The shelf of the rack 50 may be projected from the wall of the storehouse. The whole or some of the shelves of the rack 50 and support members for supporting the shelf may be movable vertically and laterally in order to take in and out storage goods. Sometimes there are provided plural racks 50 across a passage in the storehouse.

In the case of such a rack 50, even if fire extinguishing is performed, for example, from above by a fire extinguish equipment such as a sprinkler or the like, water does not enter the inside of the rack 50, so that the fire extinguishing and smoke eliminating effect can be little expected.

On the other hand, plural water mist nozzles 3 (13) are arranged on the upper position (e.g. ceiling of a storehouse) of the rack 50 or on the side position (wall), thereby spraying in such a manner as to cover the rack 50 by each water mist.

Thus, even if fine water particles do not enter the inside of the rack 50, the rack 50 is covered with the particles to smother the inside of the rack 50, thereby extinguishing a fire.

The number of the water mist nozzles 3 (13) may be one if it can smother the inside of the rack 50 to extinguish a fire.

"Fire extinguishing" and "smoke eliminating" in the description of the respective embodiments will not necessarily designate only the complete fire extinguishing and smoke eliminating case. It covers the meaning of restraint for slackening the strength of a fire and smoke.

If there are different types of objects in a section as a fire extinguishing and smoke eliminating object, it is necessary to perform different fire extinguishing and smoke eliminating depending on the types of objects and smoke. According to one aspect of the present invention, each room is provided with a water mist nozzle for spraying fine water particles with a designated particle diameter depending on the types of the objects and smoke. The water mist nozzles corresponding to the types of the objects stored in the room and smoke can be selectively operated so as to efficiently perform fire extinguishing and smoke eliminating for either type of objects and smoke and hold down damage by water to the minimum.

Especially as fire extinguishing and smoke eliminating are performed with fine water particles, the quantity of water used is small and damage by water such as inundation of the floor and a lower floor can be reduced. Further, an environmental problem is not caused.

According to another aspect of the invention, spraying of fine water particles from the respective water mist nozzles is opened and closed by a valve opening and closing mechanism, and the temperature and the smoke density are detected by each room. According to the detected temperature and smoke density, the control device specifies the place where a fire is caused. The water mist nozzle of the specified place is controlled to operate, so that fire extinguishing and smoke eliminating can be performed efficiently with the minimum quantity of water so as to prevent damage by water in another room.

Further, according to another aspect of the invention, a water mist nozzle for spraying fine water particles and another fire extinguishing equipment adapted to extinguish a fire in a different fire extinguishing form from that of the fine water particles are disposed in a section as a fire extinguishing and smoke eliminating object. At the time of a fire, according to the state of the fire, another fire extinguishing equipment and fine water particles are used jointly or separately so as to make the best use of the individual advantages of them.

Further by using the above jointly according to the state of a fire, it is possible to set an area of full-scale fire extinguishing work by the fire extinguishing equipment, a fire spread prevention area by fine water particles, and a fire escape passage.

For example, if the place where a fire is caused is detected, in the detected place, the fire extinguishing equipment is operated and water mist nozzles are operated in the periphery thereof, whereby while fire extinguishing is performed preponderantly for the place of occurrence and the spread of the fire is prevented in the other place, a fire escape passage can be formed.

In a fire extinguishing section of a room unit or the like, water mist nozzles are arranged at least along the wall of the room, or the corner part. Thus, the visual range at the corner of the room can be secured so as to prevent losing of a fire escape passage.

In a height space such as a well or a staircase of a plural-storied building, the number of water mist nozzles arranged is increased in the direction of the height. Thus, smoke in the higher floor part can be eliminated to be effective for preventing damage by the smoke.

If a large number of water mist nozzles are provided in a section directly or indirectly adjacent to a fire extinguishing section such as an entrance, a fire escape passage part or the like, the visual range on the fire escape passage can be secured to enable suitable escape.

According to another aspect of the invention, the water mist nozzle is arranged to be operated in such a manner that a nozzle orifice for spraying fine water particles is positioned at a designated height below the height position of the ceiling of the room as a fire extinguishing section. Thus, the smoke below the height of the room can be eliminated preponderantly so as to secure a fire escape passage.

According to another aspect of the invention, if a rack having plural shelves is provided at a designated height in a fire extinguishing section, a water mist nozzle adapted to spray fine water particles in such a manner as to cover the rack is arranged. Thus, fine water particles are sprayed from the nozzle to smother the inside of the rack, thereby extinguishing a fire.

What is claimed is:

1. A fire extinguishing and smoke eliminating apparatus using water mist, comprising:

at least one water mist nozzle adapted to spray fine water particles with designated different particle diameters suitable for different types of smoke which will be generated, said at least one water mist nozzle being located in a section for fire extinguishment and smoke elimination, and control means connected to the at least one water mist nozzle, said control means determining a type of generated smoke in the section for the fire extinguishment and smoke elimination and allowing said water mist nozzle to spray fine water particles with a designated particle diameter suitable for the type of the generated smoke.

2. A fire extinguishing and smoke eliminating apparatus according to claim 1, wherein said at least one water mist nozzle includes one nozzle which provides the water particles with the different particle diameters by water pressure supplied to the one nozzle.

3. A fire extinguishing and smoke eliminating apparatus according to claim 1, wherein said at least one water mist nozzle includes first and second water mist nozzles providing the water particles with the different particle diameters.

4. A fire extinguishing and smoke eliminating apparatus using water mist, comprising:

water mist nozzles provided in each section for fire extinguishment and smoke elimination and having valves for the respective nozzles, said water mist nozzles in each section being adapted to spray fine water particles with designated different particle diameters suitable for different types of smoke which will be generated in each section;

smoke density detecting means provided in each section to detect smoke density in said section and output a signal corresponding to the smoke density;

a control device connected to the smoke density detecting means in each section, said control device storing a type of an object existing in said section to determine a type of smoke to be generated and select at least one of the water mist nozzles suitable for the smoke generated in said section when the density of smoke reaches a designated smoke density preset by the type of the object according to said smoke density signal; and a valve opening and closing mechanism for opening and closing the valves, said valve opening and closing mechanism opening and closing at least one of the valves suitable for the generated smoke to start and stop spraying operation of water mist through they water mist nozzle under the control of said control device.

5. A fire extinguishing and smoke eliminating apparatus using water mist, comprising:

water mist nozzles provided in each section for fire extinguishment and smoke elimination and having valves for the respective nozzles, said water mist nozzles in each section being adapted to spray fine water particles with designated different particle diameters suitable for different types of smoke which will be generated in each section;

temperature detecting means provided in each section to detect temperature in said section and output a signal corresponding to the temperature;

a control device connected to the temperature detecting means in each section, said control device storing a type of an object existing in each section to determine a type of smoke to be generated and select at least one of the water mist nozzles suitable for the smoke generated in each section when the temperature of smoke reaches a designated temperature preset by the type of the object according to said temperature signal; and a valve opening and closing mechanism for opening and closing the valves, said valve opening and closing mechanism opening and closing at least one of the valves suitable for the generated smoke to start and stop spraying operation of water mist through the water mist nozzle under the control of said control device.

6. A fire extinguishing and smoke eliminating apparatus using water mist, comprising:

water mist nozzles for spraying fine water particles;

fire extinguishing equipments for extinguishing a fire different from said water mist nozzles for spraying fine water particles, said water mist nozzles and fire extinguishing equipments being arranged in a section for fire extinguishment and smoke elimination;

detecting means for detecting at least one of an elapsed time after occurrence of a fire and a place where a fire is caused; and operating means connected to said water mist nozzles and said fire extinguishing equipments, said operating means, upon receiving information of a fire detected by said detecting means, operating the water mist nozzles and fire extinguishing equipments such that at least one of the fire extinguishing equipments near the fire is operated and the water mist nozzles away from the fire are operated.

7. A fire extinguishing and smoke eliminating apparatus according to claim 6, wherein said section includes a designated room, a door area and a passage for going in and out of said room, said water mist nozzles being arranged such that a number of the water mist nozzles disposed in the door area and the passage is greater than that in the room in said section.

8. A fire extinguishing and smoke eliminating apparatus according to claim 6, wherein said operating means also has a function for determining a type of smoke generated in the section for the fire extinguishment and smoke elimination and allowing at least one of the water mist nozzles to spray the fine water particles with a designated particle diameter suitable for the type of the generated smoke.

9. A fire extinguishing and smoke eliminating apparatus using water mist, comprising:

water mist nozzles for spraying fine water particles for fire extinguishment arranged in a section and another section adjacent to said section;

detecting means for detecting a place where smoke is generated at a designated temperature and a designated density upon occurrence of a fire; and operating means connected to the detecting means and the water mist nozzles for operating said water mist nozzles according to a state of the fire detected by said detecting means, said operating means operating the water mist nozzles such that when the detecting means detects smoke with the designated density and less than the designated temperature, the water mist nozzles at a detected place and adjacent thereto are operated.

10. A fire extinguishing and smoke eliminating apparatus according to claim 9, wherein said operating means also has a function for determining a type of smoke generated in the section for the fire extinguishment and smoke elimination and allowing at least one of the water mist nozzles to spray fine water particles with a designated particle diameter suitable for the type of the generated smoke.

11. A fire extinguishing and smoke eliminating apparatus according to claim 9, wherein said section includes a designated room, a door area and a passage for going in and out of said room, said water mist nozzles being arranged such that a number of the water mist nozzles disposed in the door area and the passage is greater than that in the room in said section.

12. A fire extinguishing and smoke eliminating method using water mist, comprising:

arranging water mist nozzles for spraying fine water particles and water discharge equipments for discharging fire extinguishing water with water particles greater than those ejected from the water mist nozzles, said water mist nozzles and water discharge equipments being arranged in a section for fire extinguishment and smoke elimination, detecting an elapsed time from occurrence of a fire and a place where a fire is caused;

determining a type of smoke generated in the section for the fire extinguishment and smoke elimination; and operating said water mist nozzles and water discharge equipments to extinguish a fire such that, upon detection of the fire at least one of the water discharge equipments near the fire is operated and the water mist nozzles away from the fire are operated, said water mist nozzles spraying fine water particles with a designated particle diameter suitable for the type of the generated smoke.

13. A fire extinguishing and smoke eliminating apparatus using water mist, comprising:

a support member disposed in a section for fire extinguishment and smoke elimination, said support member, upon occurrence of a fire, falling from a ceiling in the section to intercept smoke flowing therein, and a water mist nozzle attached to a lower end of the support member, said water mist nozzle having a nozzle orifice for spraying fine water particles with a particle diameter suitable for smoke elimination so that a position lower than the support member is preponderantly subjected to smoke elimination.

* * * * *